US010443270B2

(12) United States Patent
Igarashi

(10) Patent No.: US 10,443,270 B2
(45) Date of Patent: Oct. 15, 2019

(54) LOCK, LOCK MEMBER, LOCK MECHANISM HAVING THE LOCK MEMBER, AND SAFE HAVING THE LOCK, LOCK MEMBER, AND LOCK MECHANISM

(71) Applicant: SUNSMILET'S CORPORATION, Tokyo (JP)

(72) Inventor: Yutaka Igarashi, Yokohama (JP)

(73) Assignee: SUNSMILET'S CORPORATION, Tokyo (JP)

( * ) Notice: Subject to any disclaimer, the term of this patent is extended or adjusted under 35 U.S.C. 154(b) by 527 days.

(21) Appl. No.: 14/894,935

(22) PCT Filed: May 29, 2014

(86) PCT No.: PCT/JP2014/064304
§ 371 (c)(1),
(2) Date: Nov. 30, 2015

(87) PCT Pub. No.: WO2014/192882
PCT Pub. Date: Dec. 4, 2014

(65) Prior Publication Data

US 2016/0108644 A1 Apr. 21, 2016

(30) Foreign Application Priority Data

May 30, 2013 (JP) ..... 2013-113532
May 24, 2014 (JP) ..... 2014-107620

(51) Int. Cl.
*E05B 65/00* (2006.01)
*E05B 63/14* (2006.01)
(Continued)

(52) U.S. Cl.
CPC ..... *E05B 65/0075* (2013.01); *E05B 63/00* (2013.01); *E05B 63/14* (2013.01);
(Continued)

(58) Field of Classification Search
CPC .... E05B 65/0075; E05B 63/00; E05B 67/063; E05B 65/52; E05B 63/14; E05C 19/007;
(Continued)

(56) References Cited

U.S. PATENT DOCUMENTS 679,675 A * 7/1901 Sweigart
1,837,501 A * 12/1931 Sunnes ..... E05G 1/026 109/51

(Continued)

FOREIGN PATENT DOCUMENTS

JP 2003-285858 A 10/2003
JP 2009-62780 A 3/2009

OTHER PUBLICATIONS

International Search Report dated Sep. 16, 2014, issued in counterpart International Application No. PCT/JP2014/064304, with English translation. (5 pages).

(Continued)

*Primary Examiner* — Lloyd A Gall
(74) *Attorney, Agent, or Firm* — Muncy, Geissler, Olds & Lowe, P.C.

(57) ABSTRACT

A conventional safe proper becomes useless when unable to be locked or unlocked, thereby causing a waste of resources. Locks capable of being locked/unlocked are provided to unfasten a common fastening member, so as to open a door or lid from the body, allow each lock to be freely mounted on and dismounted from a lock mounting portion, and dispose a false lock on each lock. Operation of locking/unlocking any one of the locks is provided to enable persistent use of a common latch disposed at an identity opening of a safe proper.

14 Claims, 20 Drawing Sheets

(51) Int. Cl.

| | |
|---|---|
| ***E05G 1/00*** | (2006.01) |
| ***E05G 1/04*** | (2006.01) |
| ***E05B 65/52*** | (2006.01) |
| ***E05B 67/06*** | (2006.01) |
| ***E05B 63/00*** | (2006.01) |
| ***E05C 9/10*** | (2006.01) |
| ***E05C 19/00*** | (2006.01) |
| ***E05G 1/026*** | (2006.01) |

(52) U.S. Cl.
CPC ..... *E05B 65/52* (2013.01); *E05B 67/063* (2013.01); *E05C 9/10* (2013.01); *E05C 19/007* (2013.01); *E05G 1/00* (2013.01); *E05G 1/026* (2013.01); *E05G 1/04* (2013.01)

(58) Field of Classification Search
CPC .. E05C 9/10; E05G 1/026; E05G 1/04; E05G 1/00
USPC ..... 70/DIG. 63; 109/59 R, 59 T
See application file for complete search history.

(56) References Cited

U.S. PATENT DOCUMENTS 3,731,505 A * 5/1973 Rosenberg ..... E05B 35/12 49/465
3,988,031 A * 10/1976 Meyer ..... E05B 67/383 292/153
4,229,956 A * 10/1980 Thorburn ..... E05B 35/08 292/137
4,470,277 A * 9/1984 Uyeda ..... E05B 65/0075 292/34
4,782,675 A * 11/1988 Thorburn ..... E05B 35/12 292/148
5,196,841 A * 3/1993 Harder ..... E05B 65/0075 340/5.54
5,347,834 A * 9/1994 Ramsauer ..... E05B 35/08 70/120
7,757,523 B1 * 7/2010 Garcia ..... E05B 65/0007 292/148
2016/0110939 A1 * 4/2016 Dobbins ..... E05B 47/0012 70/263

OTHER PUBLICATIONS

Translation of International Preliminary Report on Patentability dated Sep. 11, 2015, issued in counterpart International Application No. PCT/JP2014/064304 with (Form PCT/IPEA/409). (14 pages).
Office Action dated Oct. 22, 2013, issued in counterpart Japanese Patent Application No. 2013-113532, with English translation. (5 pages).

* cited by examiner

LOCK, LOCK MEMBER, LOCK MECHANISM HAVING THE LOCK MEMBER, AND SAFE HAVING THE LOCK, LOCK MEMBER, AND LOCK MECHANISM

BACKGROUND OF THE INVENTION

Field of the Invention

The present invention relates to a plurality of locks freely mountable and demountable, with the locks having a locking/unlocking operating means of a common latch, a lock member, a lock mechanism having the lock member, and a safe having the lock, lock member, and lock mechanism.

Description of the Prior Art

A conventional safe has some drawbacks. For example, its lock cannot be changed easily, whereas its sturdy, heavy and quadrilateral handle results from wasteful office item design. From a functional perspective, the prior art discloses such functions as double locks and unlocking by any one of a plurality of locks. With reference to the prior art, terminology used hereunder with regard to the present invention is provided with definitions. The term "false lock" generally and collectively means a member which includes an entity having a locking means or a false latch and a latch which has a false (fake) latch provided in a lock.

CITATION

Patent

Citation 1: Japan Published Patent Application 2009-62780

Citation 2: Japan Published Patent Application 2003-285858

SUMMARY OF THE INVENTION

Issue Addressed by the Invention

Precious articles come in various forms, such as cash, wallets, jewelry, etc. There are difficulties in carrying all the possessions very often. This happens, for example, in the following situations: placing one's precious articles temporarily in the care of a third party or in a checkroom while riding public transportation, using a toilet during a ride, taking a shower, swimming, or visiting a factory.

A conventional safe proper does not come with any popular design but does have a receiving portion which is sturdy, heavy and invisible in order to serve an anti-theft purpose. It is time-consuming to open the safe for a security check. If the safe is made lighter and thus simpler, its security advantage will be compromised. Even if a conventional safe proper comes with double locks, its locking/unlocking operation will be complicated enough to undermine its security advantage. It is because, for example, if one combination lock is in an unlocked state, the other combination lock will be locked/unlocked in order to open/shut the conventional safe proper. In case of a lock failure or a power outage, the locking/unlocking of the safe proper cannot be effected. In the situation where a key is lost or stolen, even if the safe proper comes with a lock, any third party in possession of the lost key can unlock the safe proper, and no lock usage stopping measures can be taken; hence, the use of the safe proper cannot continue, thereby causing a waste of resources.

Therefore, in view of the aforesaid drawbacks of the prior art, the present invention provides a lock, a lock member, a lock mechanism having the lock member, and a safe having the lock, lock member, and lock mechanism, wherein, due to the operation of the locking/unlocking of a plurality of locks, a common fastening member gets unfastened to thereby open a door or a lid from a body.

Means of Addressing the Issue

Regarding the means of addressing the aforesaid issues, the present invention provides a lock having a common fastening member disposed at an identity opening at a junction of a body and a door capable of being opened and shut freely, wherein the lock is mounted on a plurality of locks mounting portions of a lock clutching member disposed at the body, the door or both to receive a latch and a false lock, using a space created to remove the lock clutching member and thereby mount the lock on or dismount the lock from the lock mounting portion in a locked state, wherein the latch protrudes or the false lock is in an upright state, characterized in that: the lock has a means of opening and shutting the identity opening by two sub-means, wherein one of the two sub-means is, when any one of the locks is in a locked state and cannot be unlocked, adapted to controllably keep the fastening member in an unlocked state or a locked state with the latch moving in response to operation of a locking/unlocking-oriented operating portion of any other said lock, wherein another sub-means is, when any one of the locks is in an unlocked state and cannot be locked, adapted to controllably keep the fastening member in a locked state or an unlocked state with the latch attributed to any other said lock and stop the fastening member upright forcibly with the false lock of the locks.

The present invention further provides a lock which is mounted by changing a surface of the lock mounted on the lock mounting portion, wherein the lock has a means of mounting the lock on the lock mounting portion when a main surface of an operating portion capable of locking/unlocking and disposed in the lock is rotated and the operating portion is concealed, so as to stop operating the operating portion capable of locking/unlocking and disposed in the lock.

The present invention further provides a lock mounting portion which has the lock clutching member for mounting a lock in a freely mountable and demountable manner. The lock clutching member and lock can be mounted on and dismounted from the body and the door capable of being opened and shut freely when opened in the unlocked state, characterized by: a means of mounting on the lock mounting portion a main surface attributed to the lock and having the operating portion or a display surface being opposite to the main surface, not having the operating portion, and facing the body or the door; and a means of removing the lock clutching member and creating a mounting/dismounting space of the lock, so as to move the lock associated with a latch which protrudes in a locked state or the lock associated with a false lock in an upright state and in a locked state to the space thus created, thereby mounting and dismounting the lock.

The present invention further provides a lock mounting portion which downsized and equidistantly spaced apart locks are mounted on, characterized by: a means of stacking and mounting downsized and equidistantly spaced apart locks on the lock mounting portion and performing a locking/unlocking operation on the locks; and a means of mounting and dismounting a lock receiving case which the locks are stacked and mounted on.

The present invention further provides a lock mounting portion having the same advantage as the false lock of the lock to mount and dismount a member having a shape of an entity independent of the lock and functioning as a false latch, characterized by a means of mounting a member functioning as the false latch on the lock mounting portion and stopping a common fastening member forcibly.

The present invention further provides a lock mechanism comprising the lock and comprising protective members and a latch mechanism of latch-like members arranged in series, characterized by: a means of aligning a latch having a latch plate disposed in the lock mechanism with a body and an inner wall of a door capable of being opened and shut freely, and stopping movement of the latch and the body by a variation in arrangement of the latch while the latch plate and the inner wall are opposing each other, facing each other, or engaging with each other; and a means of putting the protective member between the latch-like member disposed at the lock mechanism and the latch of the lock, thereby reducing, evading or blocking a destructive force directly sustained from the outside relative to the latch of the lock.

The present invention further provides a protective member adapted to protect the lock mounted on the lock mounting portion, characterized by a means of putting the protective member between the latch-like member disposed at the lock mechanism and the latch of the lock to thereby enclose or hide the latch of the lock.

The present invention further provides a protective member capable of latching and moving in response to a locking/unlocking operation performed by the latches of the locks, characterized by a means of stacking and mounting downsized and equidistantly spaced apart locks (two locks with half of the dimensions, and three locks with one-third of the dimensions) on a lock mounting portion to allow the latches to clutch the protective member simultaneously because of the locking operation of the locks and keeping a common fastening member in a locked state, such that the protective member clutched by the latches enter an operating state to allow the fastening member to effectuate an unlocked state only when the latches are unlocked simultaneously because of the unlocking operation of the locks.

The present invention further provides a lock receiving case which has a means of stacking laminated, downsized and equidistantly spaced apart said locks and performing a locking/unlocking operation of the locks for simultaneous use, characterized in that: the lock receiving case has another means of allowing a lock engaging portion of the lock receiving case to engage with the lock engaging portions of the locks exhibiting exchangeability and mounting on a lock mounting portion the lock receiving case which the locks are mounted on without changing outer shape or outer capacity of the locks.

The present invention further provides a body and a door capable of being opened and shut freely, comprising a lock mounting portion having the lock, applicable to a building, a receiving member, a transport object having a receiving portion, or a device or member capable of being locked.

The present invention further provides a safe proper, comprising the lock, the lock mechanism and the lock mount member attributed to a lightweight reinforcing member for rendering a structure of a member compact and lightweight, and adapted to be mounted in and dismounted from an inside of a body and a door capable of being opened and shut freely, the safe proper having: a means of taking on a shape resulting from visualization and design processing effectuated by a fiber reinforced plastic conclusive of a transparent or translucent synthetic resin or composite material, releasing a fastener of the lock mounting portion, mounting and dismounting a lock clutching member, and mounting the lock receiving a latch and a false lock in an unlocked state and the lock causing the latch to protrude in a locked state or rendering the false lock upright on the lock mounting portion disposed inside the body and the door; another means of mounting a lock mounting/dismounting engaging member on a lock receiving case which the lock is mounted on and inside the body and the door; and yet another means of concealing the inside of the safe proper and a locking/unlocking-oriented operating portion of the lock, inclusive of display portions, such as rotating discs and digital discs, with optical liquid crystals, electrical liquid crystals, or concealing members of the safe proper.

The present invention further provides a safe proper, characterized in that: the aforesaid safe proper has a lock, a lock mechanism and a lock mounting portion which comprise lightweight and sturdy members, wherein the lightweight and sturdy members are bin-shaped, cylindrical, cap-shaped, cavitated as a result of its beehive-like structure, solid, thin-rod-shaped, or thin-panel-shaped, and are produced by design processing.

The present invention further provides a safe proper which has a means of maintaining its persistent use because an identity opening thereof is opened and shut with any one of the locks, whether in a locked state or an unlocked state, wherein the means employs three sub-means in opening and shutting the identity opening with any one of the locks, wherein, with one sub-means, when any one of the locks cannot perform an unlocking operation in a locked state, any other said lock performs a locking/unlocking operation, wherein, with another sub-means and an operating means, when any one of the locks cannot perform a locking operation in an unlocked state, the another sub-means causes the false locks of the locks in an unlocked state to enter an upright state and thus be mounted on the lock mounting portions to thereby forcibly stop a common fastening member, and the operating means cause any other said lock to perform a locking/unlocking operation, wherein, with yet another sub-means, when any one of the locks mounted on the lock mounting portion cannot perform a locking/unlocking operation, a main surface of a locking/unlocking-oriented operating portion of the lock is concealed and mounted on the lock mounting portion, or the locking/unlocking-oriented operating portion of the lock is hidden by a concealing member of the lock, so as to stop the operating portion from performing the locking/unlocking operation of the locks.

The present invention further provides an identity opening, disposed at a point at which a body and a door capable of being opened and shut freely abut against each other, having locking/unlocking operating members, a common fastening member and a stopping member, and capable of stopping the common fastening member forcibly, characterized in that the body and the door are opened and shut with means comprising: an operating means of using, when any one of the locking/unlocking operating members cannot perform an unlocking operation, any other said locking/unlocking operating member to perform a locking/unlocking operation; a forcibly stopping means of replacing, when any one of the locking/unlocking operating members cannot perform a locking operation, the locking/unlocking operating member incapable of performing a locking operation to perform a locking/unlocking operation by the operating means and using the stopping member of the identity opening to perform a locking operation; and another operating means of using any other said locking/unlocking operating member to perform a locking/unlocking operation, wherein the identity opening portion also has an opening/shutting means of maintaining persistent use of a safe proper, replacing removable locks and false locks, and bringing about the same effect and advantage with the mounted locking/unlocking operating members and stopping members, wherein a plurality of locking/unlocking operating means and forcibly stopping means are employed.

The present invention further provides an identity opening. The identity opening has a lock, a lock mounting portion for mounting and dismounting the lock, a common fastening member and a stopping member and is capable of stopping the common fastening member forcibly, characterized in that the body and the door are opened and shut with means comprising: an operating means of using, when any one of the locks cannot perform an unlocking operation, any other said lock to perform a locking/unlocking operation; a forcibly stopping means of replacing, when any one of the locks cannot perform a locking operation, the lock incapable of locking and using the stopping member to perform a locking operation; and another operating means of using any other said lock to perform a locking/unlocking operation.

The present invention further provides an identity opening adapted to mount a lock with a false lock on or dismount a lock with a false lock from a lock mounting portion of the identity opening, characterized in that the body and the door are opened and shut with means comprising: an operating means of using, when any one of the locks cannot perform an unlocking operation, any other said lock to perform a locking/unlocking operation; another means of replacing, when any one of the locks cannot perform a locking operation, the lock incapable of locking and using the false lock or the stopping member of the identity opening to forcibly stop; and another operating means of using any other lock to perform a locking/unlocking operation.

The present invention further provides a lock clutching member whereby a lock is mounted on and dismounted from a lock mounting portion, characterized by: a means of removing the lock clutching member of the lock mounting portion to thereby create a space and using the space thus created such that the lock can be mounted on and dismounted from the lock mounting portion even if a false lock and a latch of the lock are in a protruding state or a receiving state; and a member which can be easily mounted on and dismounted from the lock mounting portion even if a false lock and the lock in an unlocked state, a locked state, a protruding state or a forcibly stopping state. The present invention further provides a lock clutching member, characterized in that the lock clutching member which functions as an external lid engaged with a lock mounting portion or is mounted inside the lock mounting portion to thereby occupy the internal space required for mounting and dismounting the lock mounted on the lock mounting portion.

The present invention further provides a lock mechanism, having an inclined plane capable of wedging apart a protective member or the protective member and a latch-like member, characterized by a corresponding movement means of being proportional to a pressing force of the latch-like member being abutted against to thereby produce a wedging effect from the inclined plane and push the protective member inward in a locking direction, thereby augmenting/reducing a stopping force.

The present invention further provides a horizontal stabilizing member, disposed at a local point of an inclined plane of a latch-like member and adapted to keep the front-to-rear-connected, upward-to-downward-connected, leftward-to-rightward connected, or obliquely orientated inclined plane horizontal, characterized by a means of pressing against, under a specific pressing force, the horizontal stabilizing member being abutted against to form an angle of the inclined plane and produce a wedging effect with the angle of the inclined plane of the latch-like member, thereby enhancing/reducing the locking resulting from the press exerted in a stopping direction while being proportional to the pressing force.

Advantage of the Invention

Regarding the advantages of the present invention, the lock according to an embodiment of the present application has a lock with a forcibly stopping means, wherein the forcibly stopping means has a false lock for replacing a latch of a lock incapable of being locked and removing the lock clutching member to thereby provide a mounting/dismounting space for the lock, and a means of mounting the false lock on a lock mounting portion while the false lock is protruding and stopping a locking and unlocking operation.

The lock according to an embodiment of the present application also has a means whereby, even if any one of the locks mounted cannot be locked or unlocked, the lock can be temporarily removed from the lock mounting portion, then the lock's main surface which has a locking/unlocking-oriented operating portion is turned toward the other side, and eventually the lock is mounted again, so as to conceal the locking/unlocking-oriented operating portion and stop the locking operation and unlocking operation.

The lock mounting portion according to an embodiment of the present application has a lock clutching member which can be mounted on the main surface attributed to the lock and having a locking/unlocking-oriented operating portion or mounted on another surface (each surface in case of multiple angles) of the lock. Moreover, with the lock clutching member being mounted and dismounted, the lock can be easily mounted on and dismounted from the lock mounting portion during an operating state in which the false lock and the latch of the lock protrude.

The lock mounting portion according to an embodiment of the present application enables equidistantly spaced apart locks to be directly stacked and mounted on a lock receiving case, for example, using locks which are downsized and have the same structure, to upgrade a safety level (twofold or threefold) even though the lock mounting portion remains the same.

Regarding the lock mounting portion according to an embodiment of the present application, even if it has the same advantage as the false lock of the lock to mount and dismount a member having a shape of an entity independent of the lock, it can also be mounted on the lock mounting portion to thereby forcibly stop a common fastening member.

The lock mechanism according to an embodiment of the present application comprises latch mechanisms arranged in series, wherein, with a means of disposing the protective member between the latch mechanism, the direction of the vector of the destructive force directly sustained from the outside relative to the protective member is changed to a perpendicular direction or a parallel direction, wherein, relative to the latch of the lock, it is feasible to evade or stop pushing in (or pulling out) the direction of the vector of the destructive force in the direction of a collision state.

The protective member according to an embodiment of the present application is disposed at a lock mechanism to protect the false lock and the latch of the lock by hiding or enclosing them, and is capable of latching corresponding to a locking or unlocking operation. For example, if a person who is ignorant of the correct number unlocks two locks each with a 10-digit number inscribed on their combination locks, there will be 10.times.2, that is, 20, unlocking methods for unlocking the two locks. However, in the situation where the protective member of the present invention is locked with the two locks simultaneously, even if one lock is unlocked, the other lock will still be in a locked state. Hence, it is only when the locks are simultaneously unlocked that the protective member of the present invention will be unlocked. Due to the aforesaid structure, an unlocking operation is carried out at the unlocking probability of 1%, i.e., 1/(10.times.10), and thus the probability of being capable of being unlocked decreases, thereby enhancing the anti-theft effect easily.

The lock receiving case according to an embodiment of the present application can mount a plurality of locks on a lock mounting portion in a single instance, wherein a groove is disposed at engaging portions of the lock and the lock case in a seamless manner. If an operating portion (display portion) of the lock is disposed at the engaging portions beforehand, it will be unnecessary to face the other side of each lock, and the locks can be mounted on the lock mounting portion when the engaging portion of the lock case conceals the operating portion while facing the main surface.

Regarding the body and the door capable of being opened and shut freely according to an embodiment of the present application, the lock of the present invention is applicable to a building, a receiving member, a transport object having a receiving portion, and a lock device, so as to serve a wide variety of purposes.

The safe proper according to an embodiment of the present application comes with members having functions and comprising lightweight reinforcing members. Moreover, the safe proper has a means of taking on a shape resulting from visualization and design processing effectuated by a reinforcing member made from a transparent or translucent synthetic resin and a means of concealing the inside of the safe proper with liquid crystals.

The safe proper according to an embodiment of the present application has an operating means of locking/unlocking a plurality of locks, a means of performing forcible stopping with a false lock, and a means of stopping a locking operation and an unlocking operation to thereby maintain the persistent use of the safe proper.

The identity opening according to an embodiment of the present application has a locking/unlocking operating member, a common fastening member, a stopping member, and a lock mounting portion, wherein the lock equipped with a false lock can be mounted on and dismounted from the lock mounting portion, characterized by: a means whereby, when any lock or locking/unlocking operating member cannot be unlocked, any other lock or locking/unlocking operating member can perform a locking/unlocking operating; a means of replacing, when any lock or locking/unlocking operating member cannot be locked, the lock or locking/unlocking operating member which cannot be locked and using the false lock or a stopping member having an identity opening to stop forcibly; and an operating means of using any other lock or locking/unlocking operating member to perform an unlocking operation, thereby opening and shutting the body and the door.

The lock clutching member according to an embodiment of the present application is adapted to remove the lock clutching member disposed at the lock mounting portion to thereby create a space and using the space thus created such that the lock can be mounted on and dismounted from the lock mounting portion even if a false lock and a latch of the lock are in a protruding state or a receiving state.

The lock mechanism according to an embodiment of the present application has an inclined plane capable of wedging apart a protective member and a latch-like member to augment a stopping force.

The horizontal stabilizing member according to an embodiment of the present application enables deformation of shape under a specific pressing force and enhances locking proportional to the pressing force.

BRIEF DESCRIPTION OF THE DRAWINGS

FIG. 14(A) is a front cross-sectional view of the locks and a lock clutching member engaged with a lock mounting portion; FIG. 14(B) is a top cross-sectional view of the lock clutching member with a lock mounting/dismounting engaging member and the lock mounting portion which a lock is mounted on; FIG. 14(C) is a top cross-sectional view of the lock mounting/dismounting engaging member engaged with the inner side of the body;

DETAILED DESCRIPTION OF THE EMBODIMENTS

From the perspective of implementation of the present invention, the structures and means of the present invention are hereunder illustrated with a plurality of locks in three embodiments and a variant embodiment. Common features of the embodiments and variant embodiment are described below.

1. Reference signs used in the text and the drawings refer to the same structure when composed of the same numeral but different suffixes a~r. The structure is denoted by the reference sign with the suffix a when a description of the structure is not required (but not necessarily so when a description of the structure is required.)

2. A door capable of being opened and shut freely and a body equipped with a lock, as recited in the claims, are hereunder described as a lock device or safe proper equipped with a lock.

3. A false lock and latch equipped with a lock are operated by a handle (not shown) which the lock is equipped with.

Figure 1:
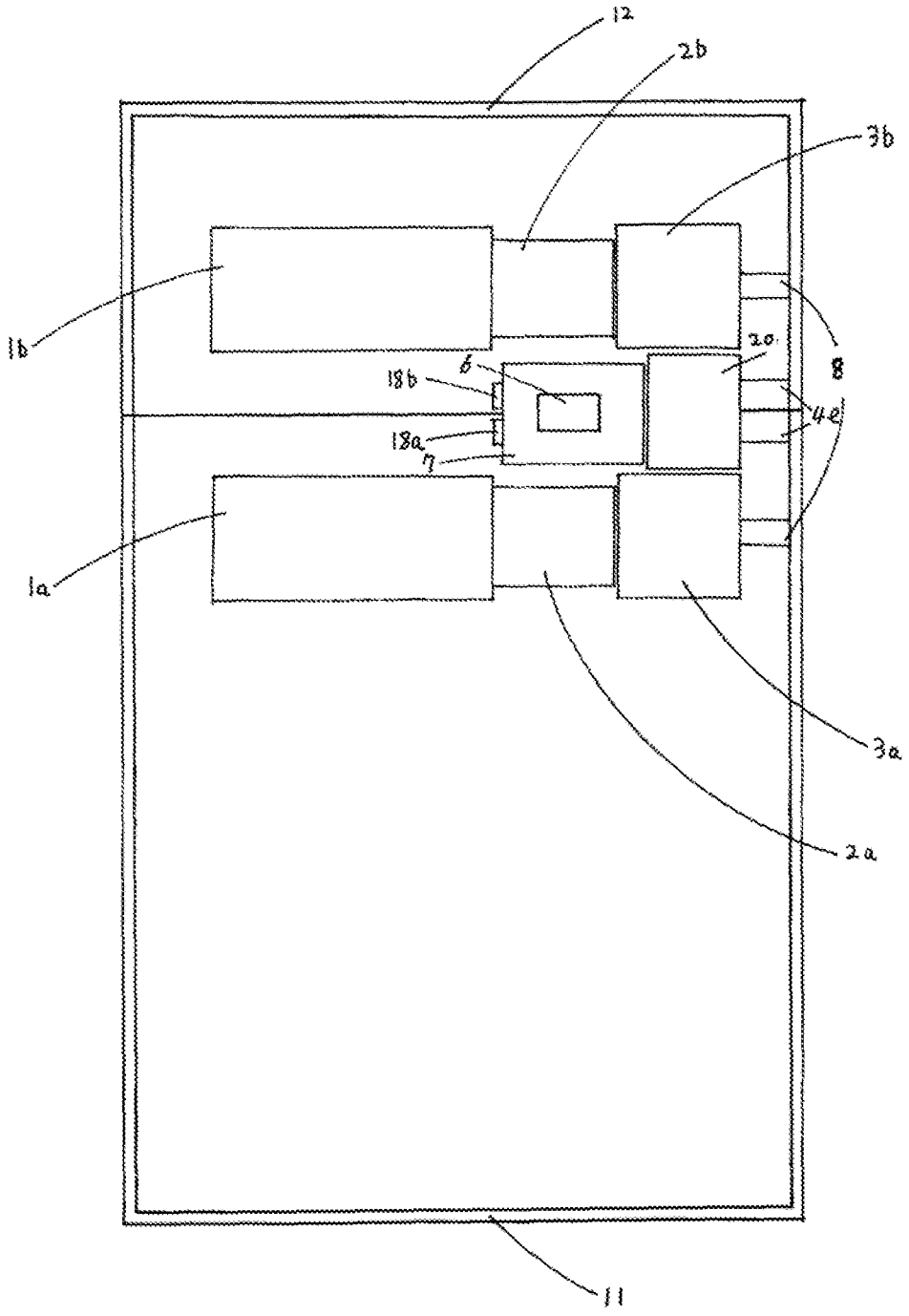
FIG. 1 is a front longitudinal cross-sectional view of a body and a lid of a pivotally-mounted safe proper.

A body, a lid, and a pivotally-mounted safe proper are illustrated with embodiment 1 for implementation of the present invention. FIG. 1 is a front longitudinal cross-sectional view of a body 11 of a safe proper and a lid 12 of the safe proper, wherein the back surface is fixed in place by a butterfly hinge (not shown).

Figure 2:
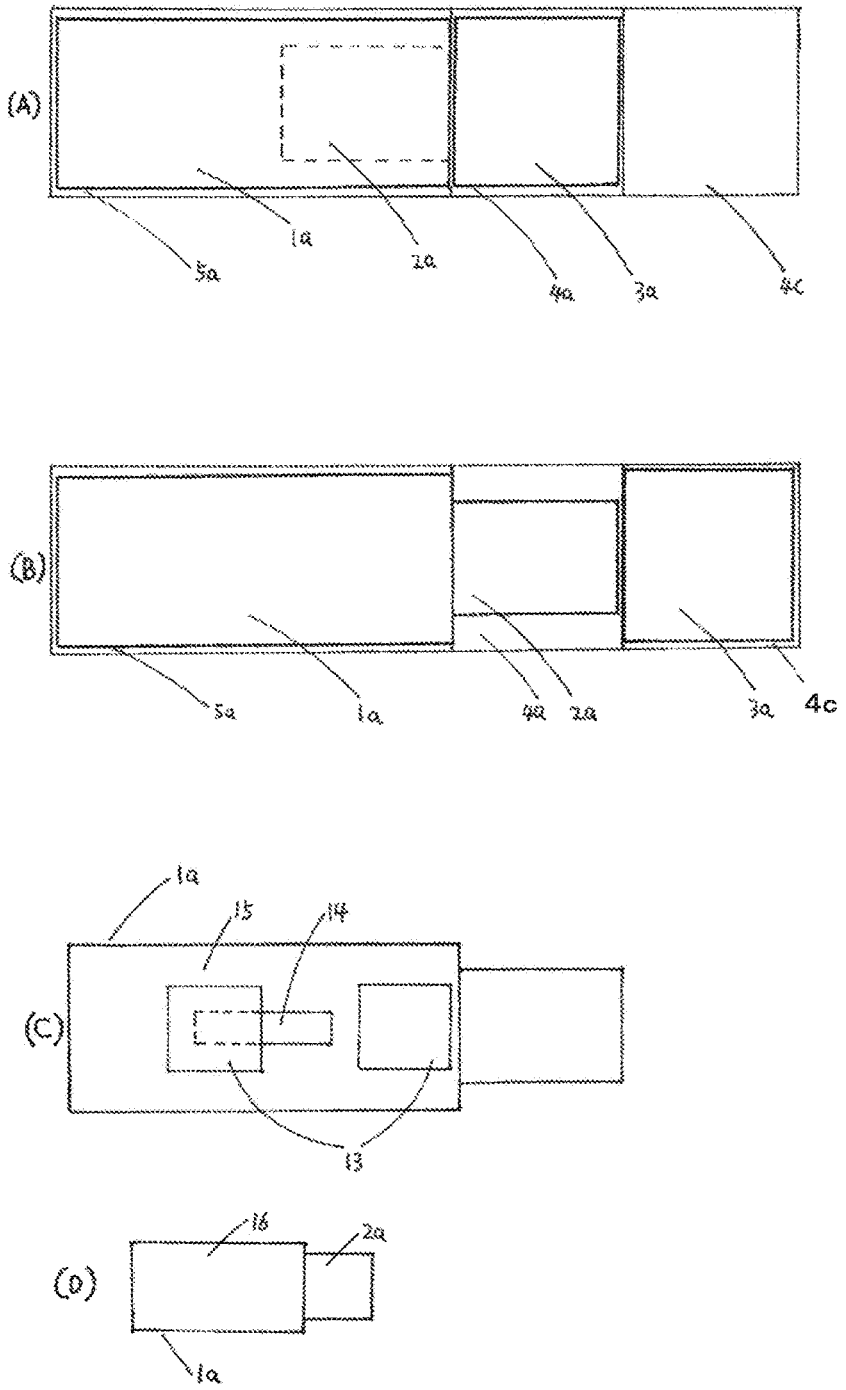
FIG. 2(A) is a cross-sectional view of a protective member and the main surface of the lock mounted on a mounting portion thereof.
FIG. 2(B) is a cross-sectional view of the protective member, a door latch and the lock.
FIG. 2(C) is a schematic view of a concealing member and an operating portion of the lock.
FIG. 2(D) is a schematic view of the back surface of the lock.
Figure 3:
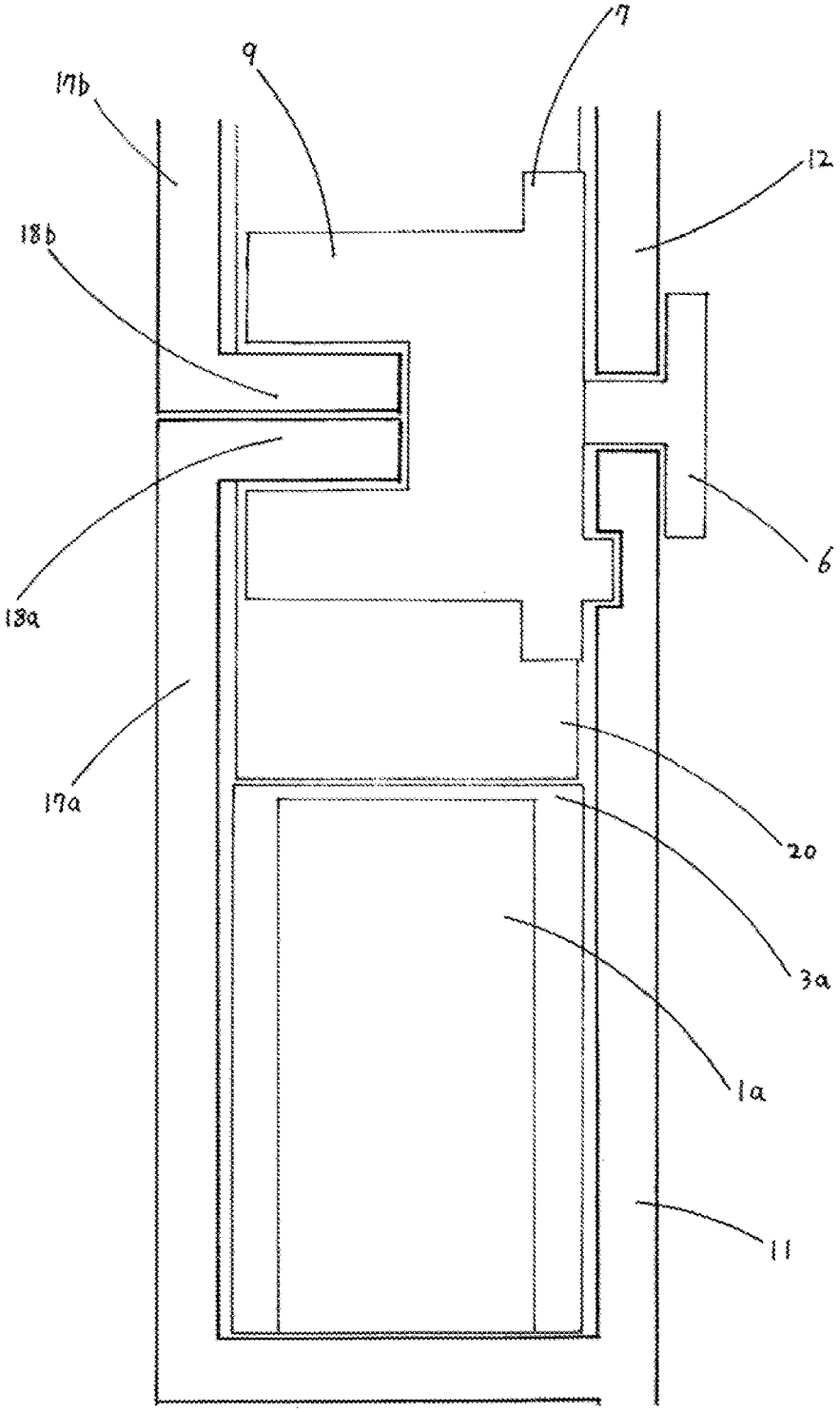
FIG. 3 is a cross-sectional view of a slidable handle.

From the perspective of a method of locking a safe proper, with a means of locking a lock 1*a* of a lock mounting portion 5*a* shown in FIG. 2(A) and provided in the body 11, a latch 2*a* of the lock 1*a* of FIG. 2(B) slides rightward, the latch 2*a* drives the protective member 3*a* capable of moving leftward and rightward freely and disposed inside the body 11 from region 4*a* rightward to region 4*c*, and in consequence the protective member 3*a* is clutched and fixed in place at region 4*c*. Referring to FIG. 1, the protective member 3*a* thus clutched and fixed in place and the protective member 3*b* currently in a locked state are stopped while a common fastening member 20 is being clamped under two opposing vertical forces. In this situation, a handle 7 cannot slide rightward to be stopped, and thus the safe proper enters a locked state. Referring to FIG. 3, the handle 7 comprises an actuating motion portion 6 disposed outside the safe proper and a clamping portion 9 disposed inside the safe proper, and the safe proper is locked as a result whenever the clamping portion 9 clamps raised portions 18*a*, 18*b* which have the same function and shape. The lock 1*a* is described above; furthermore, a lock 1*b* has the same structure and function as the lock 1*a*.

Referring to FIG. 1, the protective member 3*a* is disposed between the latch 2*a* and the common fastening member 20. The protective member 3*a* with a guide prominence engages with the body 11 with a guide groove while meshing with at least one of the inner connected surfaces of the body 11 and is mounted along the guide groove in a freely movable manner (not shown). The protective member 3*a* engages with the body 11 through an elastomer 8. Furthermore, the protective member 3*a* accumulates potential energy through the elastomer 8 to thereby approach the lock 1*a*. Referring to FIG. 3, at a local point of the fringe of a wall surface 17*a* of a receiving portion inside the body 11, the raised portion 18*a* faces the front of the body 11 and bends to become a bracket-shaped raised portion, whereas, at a local point of the fringe of a wall surface 17*b* of a receiving portion inside the lid 12, the raised portion 18*b* faces the front of the lid 12 and bends to become a bracket-shaped raised portion. The protective member 3*b* has the same structure and function as the protective member 3*a*.

Figure 4:
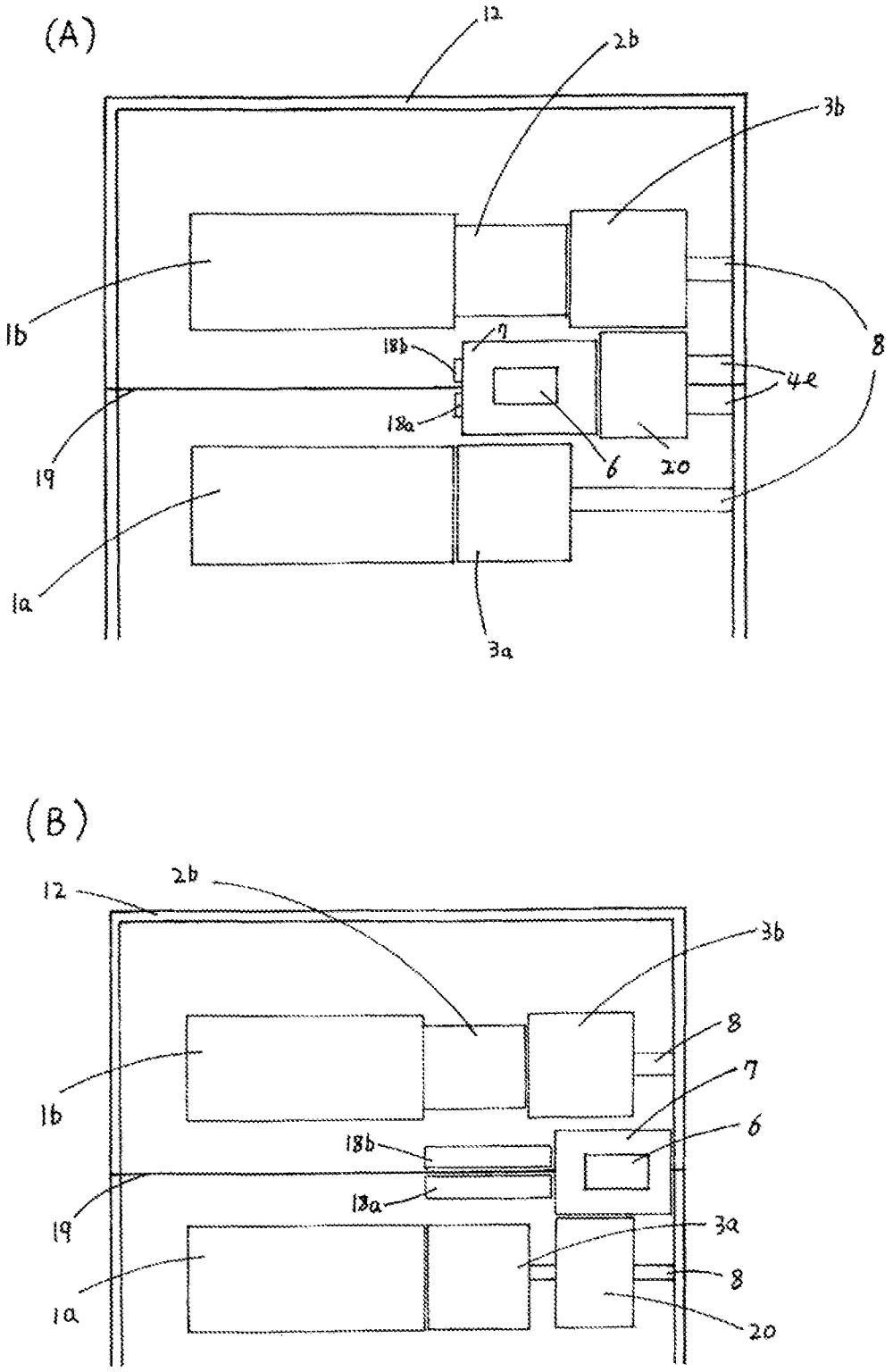
FIG. 4(A) is a front longitudinal cross-sectional view of the unlocked state of the lock for one of the body and the lid of a pivotally-mounted safe proper.
FIG. 4(B) is a front longitudinal cross-sectional view of the unlocked state of the body and the lid of the pivotally-mounted safe proper.

From the perspective of a method of unlocking the safe proper, the elastomer 8 of FIG. 4(A) drives the protective member 3*a* from region 4*c* to region 4*a* as soon as the latch 2*a* gets received inside the lock 1*a* mounted on the lock mounting portion 5*a* of FIG. 2(B) by a means of unlocking the lock 1*a*. Hence, the common fastening member 20 capable of moving freely moves to region 4*c* right at the bottom of FIG. 4(B). By operating the actuating motion portion 6 of the handle 7 protruding outward from the safe proper, the clamping portion 9 moves rightward to the space of region 4*e* of a latch open portion, whereas the latches of the raised portions 18*a*, 18*b* get opened from the clamped state of the clamping portion 9, wherein the body 11 and the lid 12 open an identity opening 19 through a butterfly hinge disposed on the back surface. The protective members 3*a*, 3*b*, the common fastening member 20 and the handle 7 together form not only a latch mechanism which comprises a plurality of latches and latch-like members combined and arranged in series but also a lock mechanism which comprises the body 11 and the lid 12.

Figure 5:
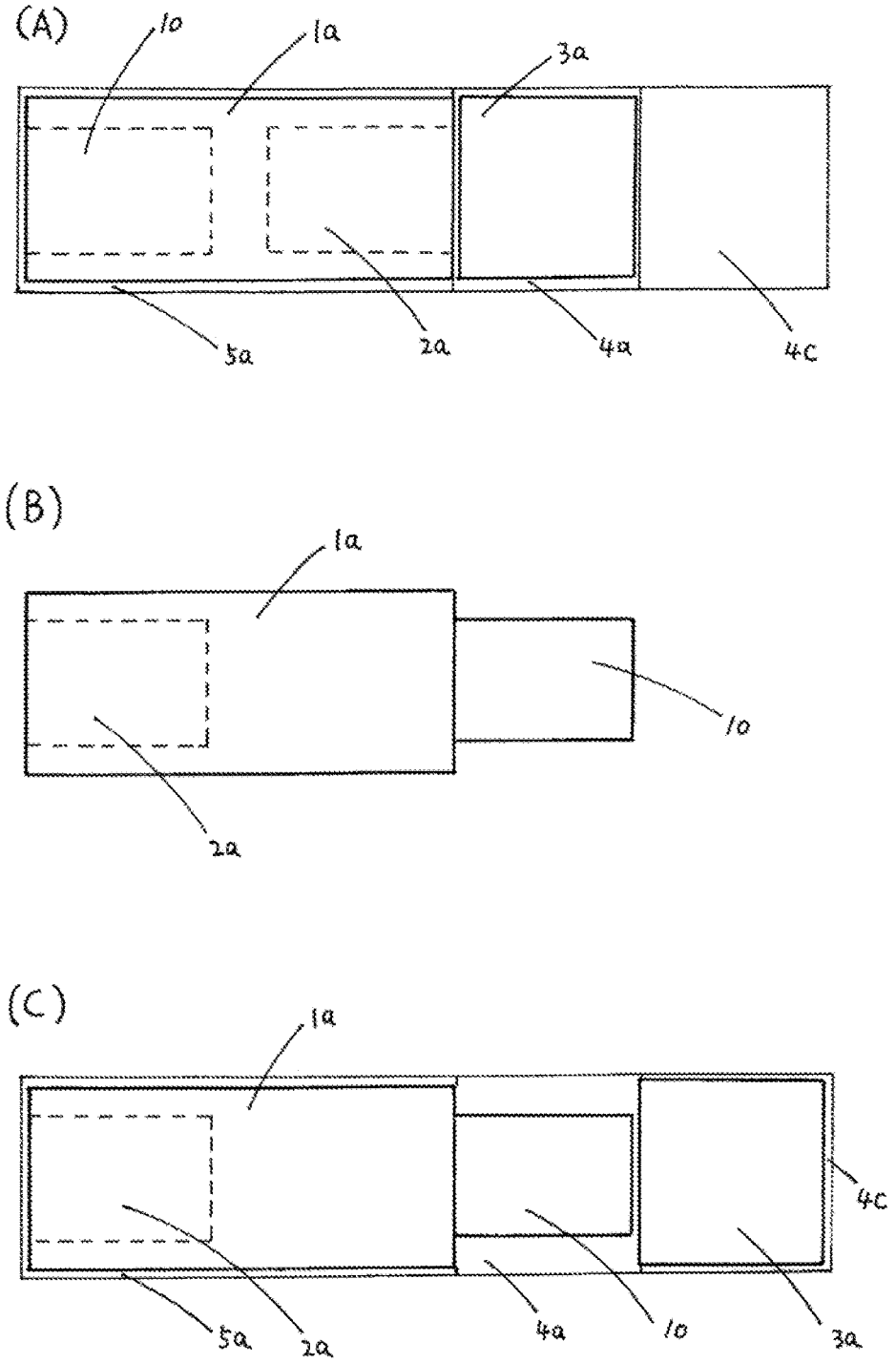
FIG. 5(A), FIG. 5(B), FIG. 5(C) are cross-sectional views of the operation of a false lock.

Take a means capable of persistent use according to the present invention as an example, in the situation where a lock mounted on a lock mounting portion cannot be locked, the safe proper which is openable gets opened in an unlocked state so as to take the lock out of the lock mounting portion temporarily. Referring to FIG. 5(A)~FIG. 5(C), for example, the front-to-rear direction of the lock 1*a* is changed to thereby slide a latching-oriented false lock 10 having the lock of FIG. 5(B) and disposed opposite to the latch 2*a* of the lock 1*a* of FIG. 5(A) such that the false lock 10 protrudes and gets replaced with the non-operable latch 2*a* of FIG. 5(C). Then, the false lock 10 which lacks a means of performing a locking/unlocking operation is mounted on the lock mounting portion 5*a* such that the protective member 3*a* gets clutched and fixed in place at region 4*c*, and in consequence the safe proper is always in a locked state to thereby stop completely a means of performing a locking operation and an unlocking operation of the lock. In this situation, a locking operation can also be performed on the lock 1*b* shown in FIG. 1 to thereby perform a closing operation and then effect the persistent use of the safe proper by a means of performing a locking/unlocking operation on the lock 1*b*. A configured false lock will be in a locked state, provided that it is not unlocked. In addition to being built-in, the false lock 10 exhibits high diversity by positioning a cap-shaped object in one direction and then changing the direction to render the cap-shaped object upright before being mounted on the lock 1*a* or rotating the cap-shaped object to render it protruding.

In the situation where there is a chance that a third party will unlock the safe proper in a locked state, a lock 1*a* or 1*b* is taken out of any one of the lock mounting portion 5*a*, 5*b* temporarily by any one of the aforesaid means and then replaced with another lock, or a lock operating portion 14 is concealed with two concealing members 13 shown in FIG. 2(C) and bilaterally movably disposed at the lock, or a main surface 15 of the lock 1*a* or 1*b* disposed at the operating portion and adapted for locking/unlocking is rotated by 180 degrees, for example, and then mounted again while facing a back surface 16 of the lock 1*a* or 1*b* shown in FIG. 2(D) and serving as one of the other surfaces of the operating portion incapable of locking/unlocking. Hence, the operating portion adapted for locking/unlocking and disposed at the lock 1*a* is not exposed from the surface of the safe proper, and thus it is feasible to stop any locking/unlocking operation completely in a locked state. In this situation, the lock 1*b* performs a locking/unlocking operation. The concealing members 13 are operated only when removing the lock 1*a* or 1 *b* from the lock mounting portion 5*a* or 5*b*.

In embodiment 1, regarding a movement operation of the common fastening member 20, a knob (not shown) is disposed at the common fastening member such that the knob protrudes outward through a through-hole disposed on the body 11 or the lid 12, and thus the knob can be moved to thereby perform the movement operation. Alternatively, the knob and the through-hole can be dispensed with, as the common fastening member 20 functions as a magnetic body, and in consequence a user of the safe proper can move the common fastening member 20 with a magnet from outside.

Figure 6:
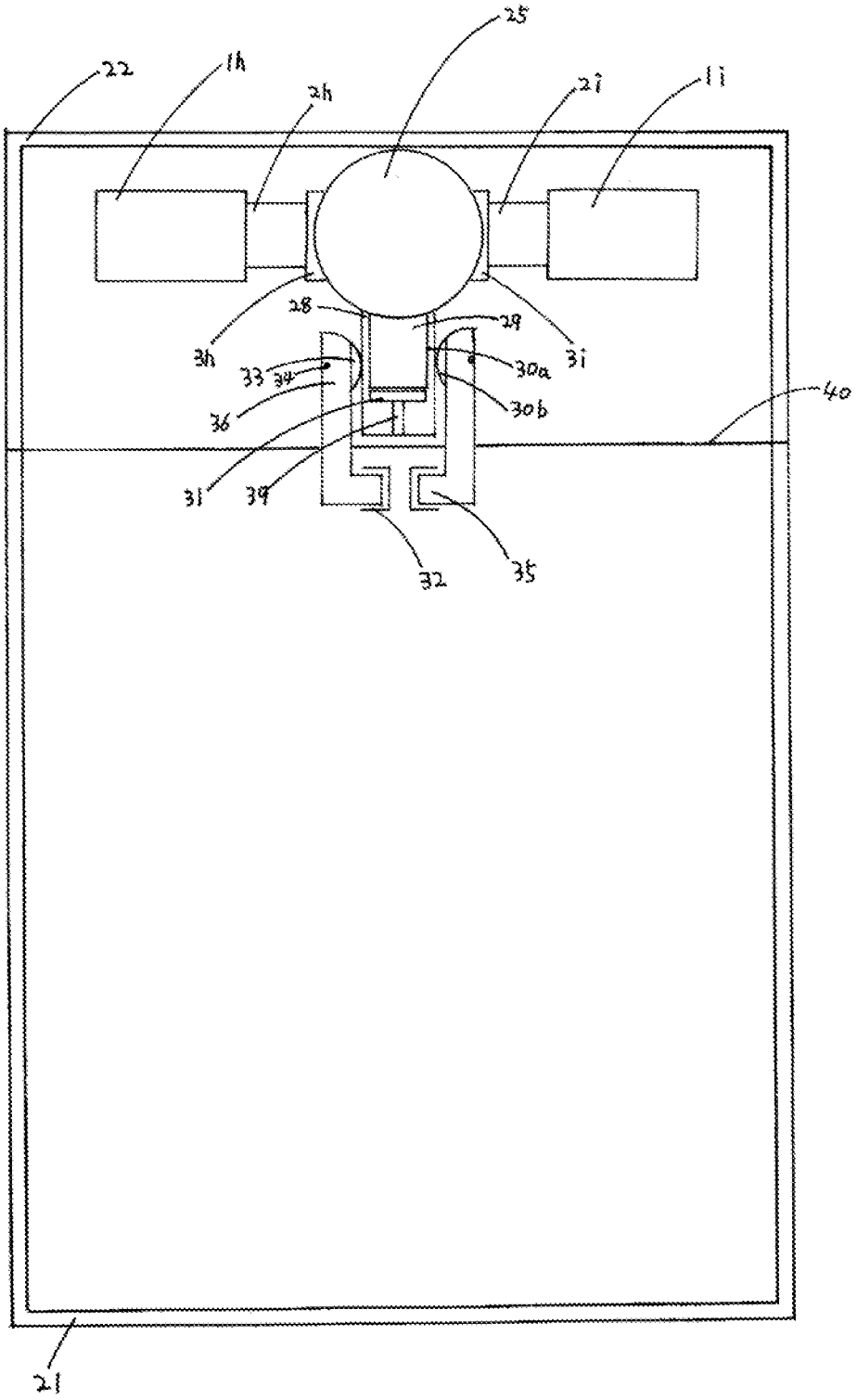
FIG. 6 is a front longitudinal cross-sectional view of a locked state of the rotatable safe proper.

The structures and means of the safe proper with a rotatable locking and unlocking operation means are illustrated with embodiment 2 for implementation of the present invention. FIG. 6 is a front longitudinal cross-sectional view of the safe proper. As shown in the diagram, a rotatable locking and unlocking operation means is disposed in front of a lid 22 of the safe proper and a body 21 of the safe proper.

Figure 7:
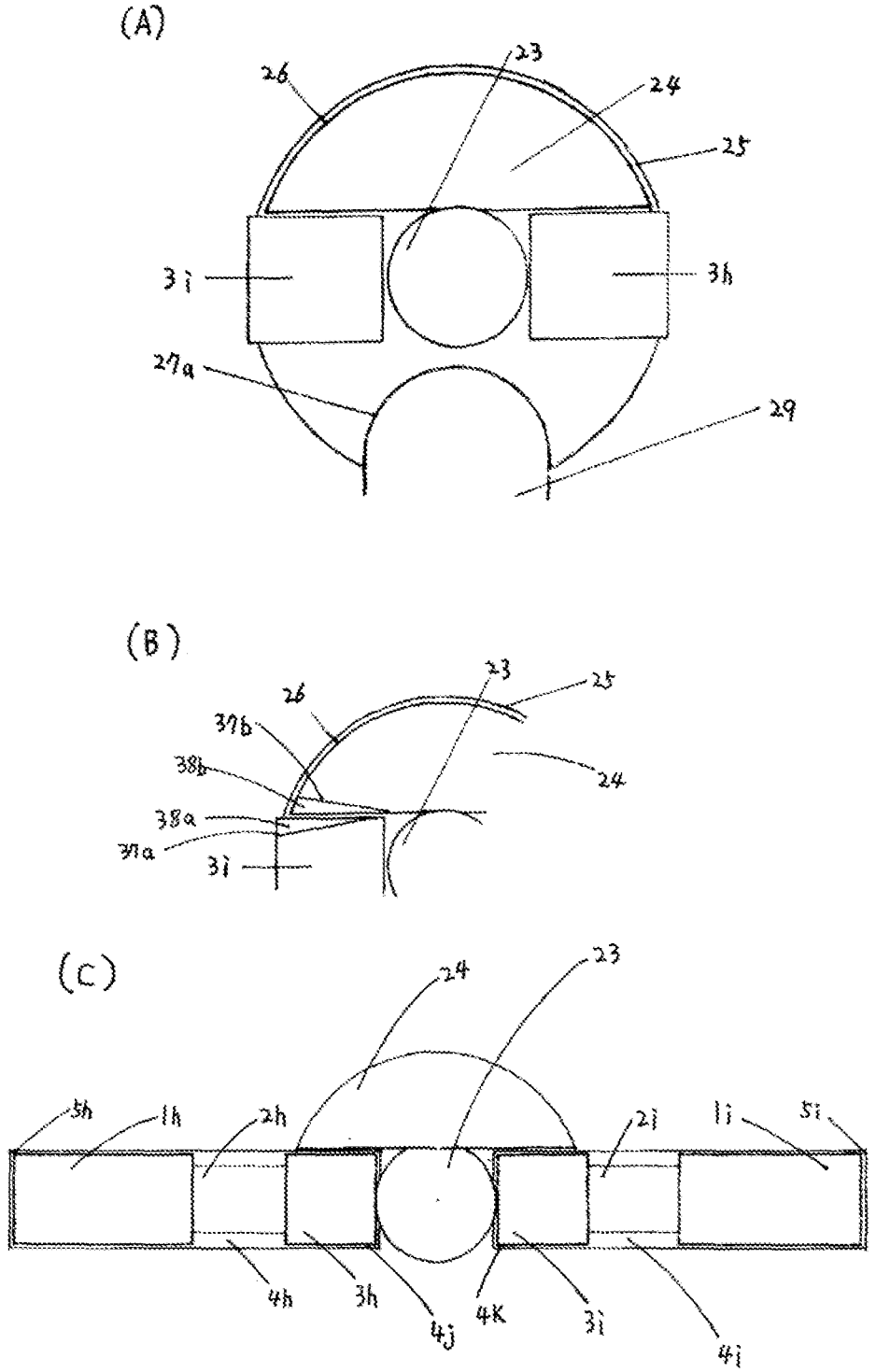
FIG. 7(A) is a rear cross-sectional view of a drum mechanism.
FIG. 7(B) is a schematic view of a horizontal stabilizing member.
FIG. 7(C) is a cross-sectional view of a locked state of a portion selected from a door latch mechanism.

From the perspective of a method of locking the safe proper, referring to FIG. 7(A)~FIG. 7(C), with a means of locking a lock 1*h* attributed to the lid 22 and mounted on a lock mounting portion 5*h* of FIG. 7(C), a latch 2*h* drives the protective member 3*h* capable of moving leftward and rightward freely to region 4*j* such that the protective member 3*h* gets clutched and fixed in place. Due to the protective member 3*h*, a round shaft 23 shown in FIG. 7(A) and adapted to function as a drum mechanism gets engaged with a semicircular latch 24 of the round shaft 23 and a disk-shaped rotation portion 25 to be leftward rotated and clutched as shown in FIG. 7(C). Due to a latch 2*i* of a lock 1*i* currently in a locked state, the protective member 3*i* clutches the latch 24 and the rotation portion 25 to rotate rightward, such that the protective members 3*h*, 3*i* cause the semicircular latch 24 and the disk-shaped rotation portion 25 to stop in a state which prevents rotation, and in consequence the safe proper enters a locked state.

Figure 8:
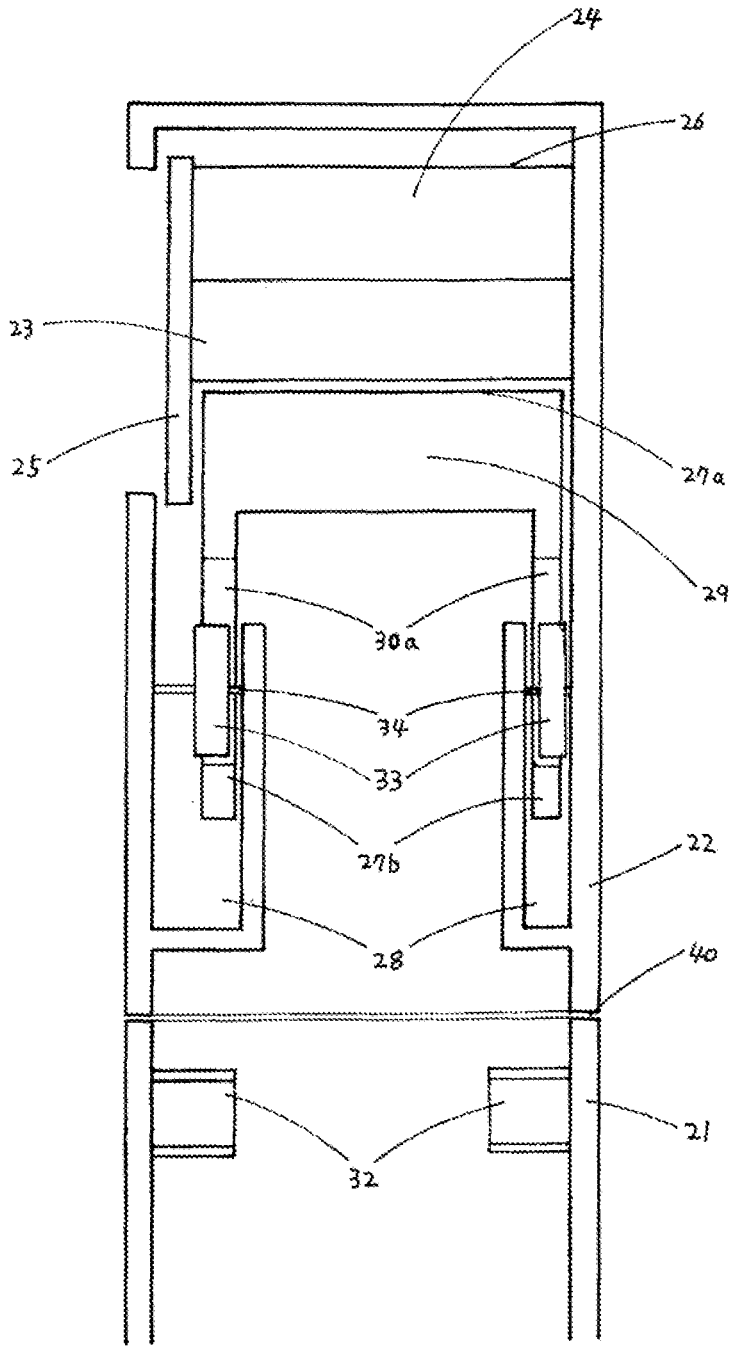
FIG. 8 is a longitudinal cross-sectional view taken transversely of the drum mechanism.
Figure 9:
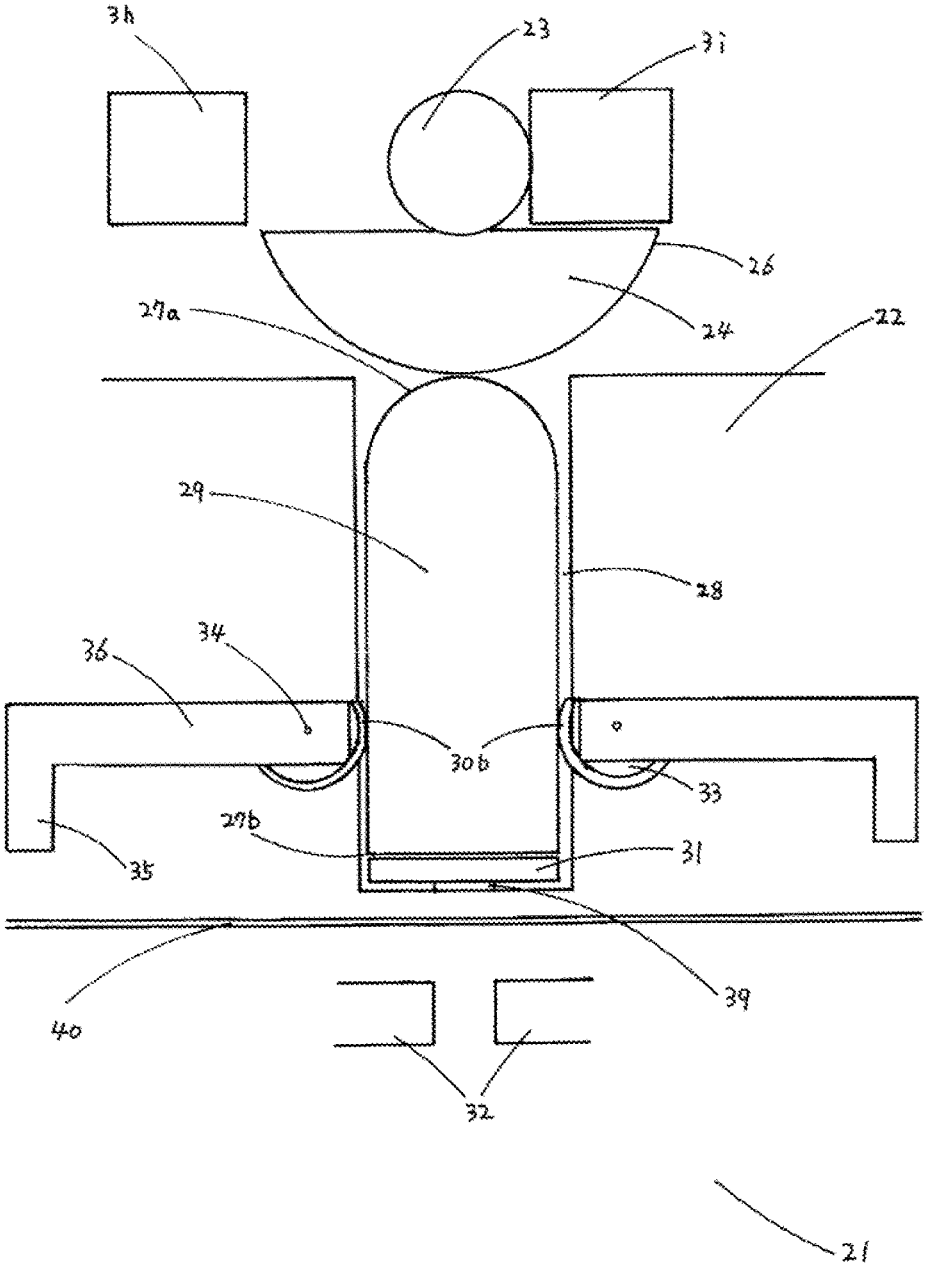
FIG. 9 is a longitudinal cross-sectional view of an unlocked state of the latch mechanism.

From the perspective of a method of unlocking the safe proper, referring to FIG. 7(C), the lock 1*h* gets unlocked, and the latch 2*h* is received in the lock 1*h*, such that the elastomer drives the protective member 3*h* to region 4*h*. Furthermore, the elastomer always drives the protective member 3*h* in the direction of the lock 1*h*. Hence, region 4*j* is empty such that, due to the stopping effect of the protective member 3*h*, the semicircular latch 24 and the disk-shaped rotation portion 25 in a state which prevents rotation rotates about the round shaft 23 leftward by 180 degrees. Referring to FIG. 9, a round end portion 27*a* at the upper portion of a common fastening member (latch) 9 is driven downward by a minor arc portion 26 of the semicircular latch 24, whereas a common fastening member 29 moves downward while opposing against the force exerted by an elastomer 39. Referring to FIG. 8, the disk-shaped rotation portion 25 can be operated from outside the safe proper. Furthermore, the upper edge portion 27*a* of the common fastening member 29 of FIG. 8 is curved and semicircular post-shaped, whereas the bottom surface of a lower edge portion 27*b* is flat. In the situation where two latch receiving portions 28 are disposed in front of the lid 22 and behind the lid 22, respectively, an engaging member 31 of FIG. 9 moves upward and downward freely to get engaged with the elastomer 39. Due to the elastomer 39, the common fastening member 29 accumulates potential energy to thereby move upward. Furthermore, gear rack portions 30*a*, which flank the common fastening member 29 and have plenty of teeth arranged, mesh with a tooth trace portion 30*b* of a gear 33 disposed opposite to the gear rack portions 30*a*. The vertical movement of each gear rack portion 30*a* causes the gear 33 to rotate. The gear 33 and a latch 36 rotate about a central shaft 34. The latch 36 and a L-shaped front end portion 35 open outward toward the left and the right to get clutched horizontally, wherein the front end portion 35 escapes from a hit board 32 of the body 21 to thereby unlock the safe proper, thereby allowing an identity opening 40 of the lid 22 and the body 21 to enter a docked separated state.

The structure and role of the protective members are described below. Referring to FIG. 7(A)~FIG. 7(C), the protective member 3*h* is disposed between the latch 2*h* and the common fastening member 29. The protective member 3*h* with a guide prominence renders the guide prominence freely movable along the guide groove and on at least one of the inner connected surfaces of the lid 22 having the guide groove. The protective member 3*h* with the guide prominence moves in a specific direction (not shown). The aforesaid features apply to the protective member 3*i* as well. With the protective member being interposed, for example, even if the semicircular latch 24 and the disk-shaped rotation portion 25 of FIG. 7(C) are forcibly rotated to the detriment of an unlocked state under an external force, the external force will come into direct contact with the protective member 3*h* or 3*i* rather than the latch 2*h* or 2*i* and the lock 1*h* or 1*i*; hence, the lock 1*h* or 1*i* and the latch 2*h* or 2*i* do not require a high degree of durability for sustain the external force and thus can be downsized and lightweight.

From the perspective of additional functions, protective member-based latching can come with a wedging effect. A horizontal stabilizing member comprises spongy, gel-like, rubber-like, and spring-shaped elastomers, a shape-memorizing member or soft deformable members. Even if the latch-like members and the protective members abut against each other, they will not push and press against each other. Hence, the horizontal stabilizing member positioned at a local point is not predisposed to deformation. Given a flat horizontal surface and a considerable pushing and pressing force, a horizontal stabilizing portion begins to form an inclined plane and an angle of inclination, wherein the pushing and pressing force is applied in a locking or stopping direction proportionally and on an inclined plane or at an angle of inclination interactively. The wedging effect brought about by the inclined plane or an angle of inclination augments the effect and advantage of locking or stopping. Referring to FIG. 7(B), at a local point of an inclined plane (an angle of inclination) 37*a* for the protective member 3*i*, the protective member 3*i* has a horizontal stabilizing member 38*a*, whereas, at a local point of an inclined plane 37*b*, the semicircular latch 24 of the disk-shaped rotation portion 25 has a horizontal stabilizing member 38*b*, such that they abut against each other. If the disk-shaped rotation portion 25 is forcibly rotated under a force applied from outside the safe proper, the horizontal stabilizing member 38*b* of the semicircular latch 24 will push and press against the horizontal stabilizing member 38*a* of the protective member 3*i* in proportion to a considerable pushing and pressing force. The horizontal stabilizing members 38*a*, 38*b* being pushed and pressed against each deform to thereby begin to form an inclined plane at a local point. The inclined plane 37*b* being abutted against pushes and presses against the inclined plane 37*a* obliquely upward by the wedging effect, such that the protective member 3*i* moves in the direction of the central portion of the round shaft 23 of the locking direction, so as to augment the locking effect and advantage by the wedging effect in proportion to the pushing and pressing force.

Even if the semicircular latch 24 has a surface which abuts against the protective members and is a flat surface (non-inclined plane) which no horizontal stabilizing member is disposed on, in the situation of an example described above, due to the rotation of the disk-shaped rotation portion 25, the semicircular latch 24 causes the inclined plane 37*a* of the protective member 3*i* to push and press obliquely upward to thereby achieve the same wedging effect. The other latch-like members in engagement are unlikely to get misaligned, loosened or unlocked because of a slight movement. Since it is a horizontal stabilizing member which maintains a horizontal state, the dynamic friction coefficients of the protective members, latches, and latch-like members remain unchanged substantially even though the protective members, latches, and latch-like members are sliding in an unlocked state, and thus the protective members, latches, and latch-like members undergo parallel movement. The shape of a member having the structures and functions of the aforesaid protective members serves as an example.

Figure 10:
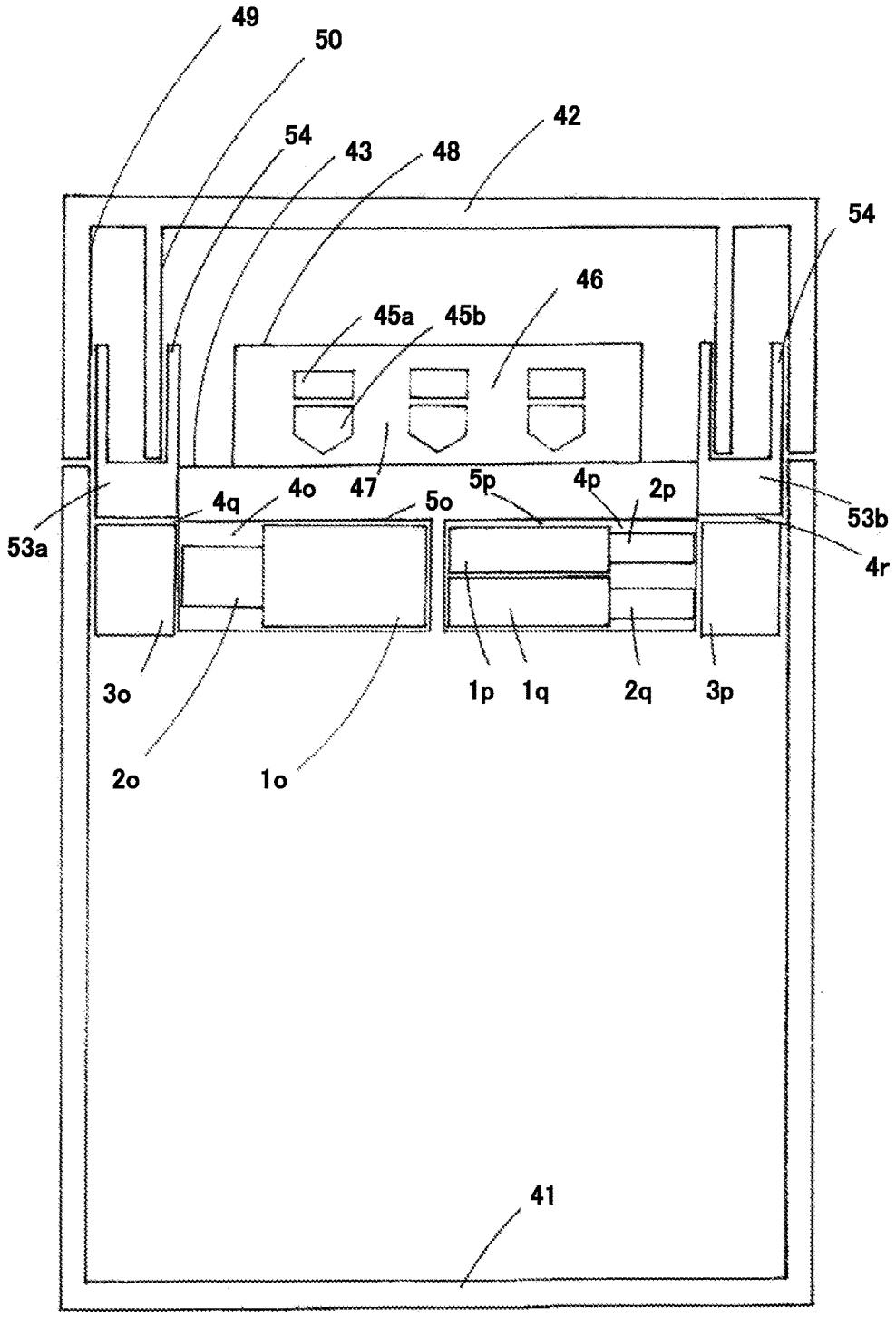
FIG. 10 is a front longitudinal cross-sectional view of a locked state of a parallel slidable safe proper.

The structures and means of the safe proper with a parallel slidable locking and unlocking operation means are illustrated with embodiment 3 for implementation of the present invention. FIG. 10 is a front longitudinal cross-sectional view of a lid 42 of the safe proper and a body 41 of the safe proper having a parallel slidable locking and unlocking operation means. For the sake of brevity, the solid line indicative of a portion of the two ends of a fringe 43 of an identity opening of the safe proper is omitted from the description herein.

Figure 11:
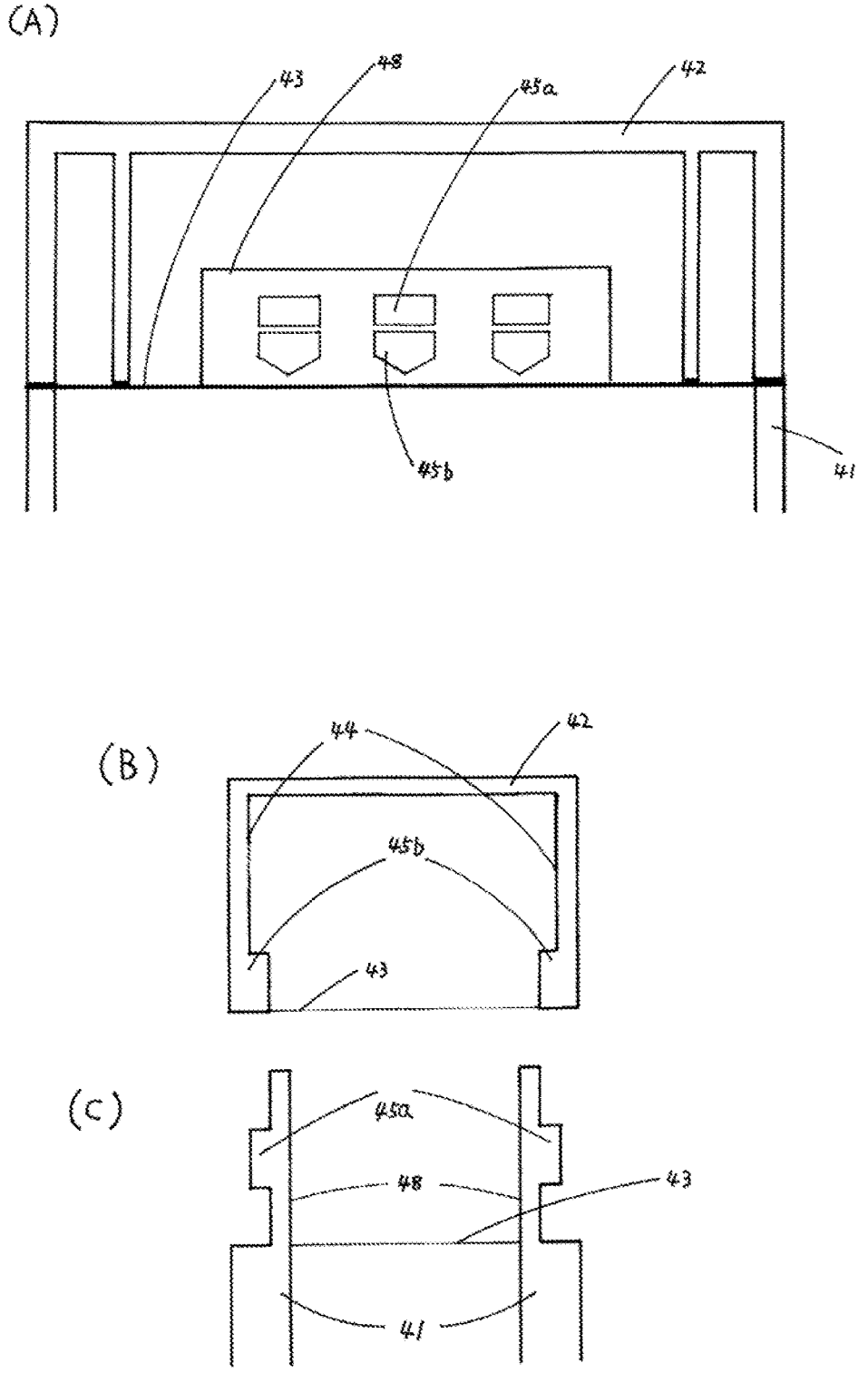
FIG. 11(A) is a cross-sectional view of a panel of a fringe of an identity opening of the body.
FIG. 11(B) is a cross-sectional view of a latch on an inward wall disposed in front of and behind the lid.
FIG. 11(C) is a cross-sectional view of a latch disposed at the body.
Figure 12:
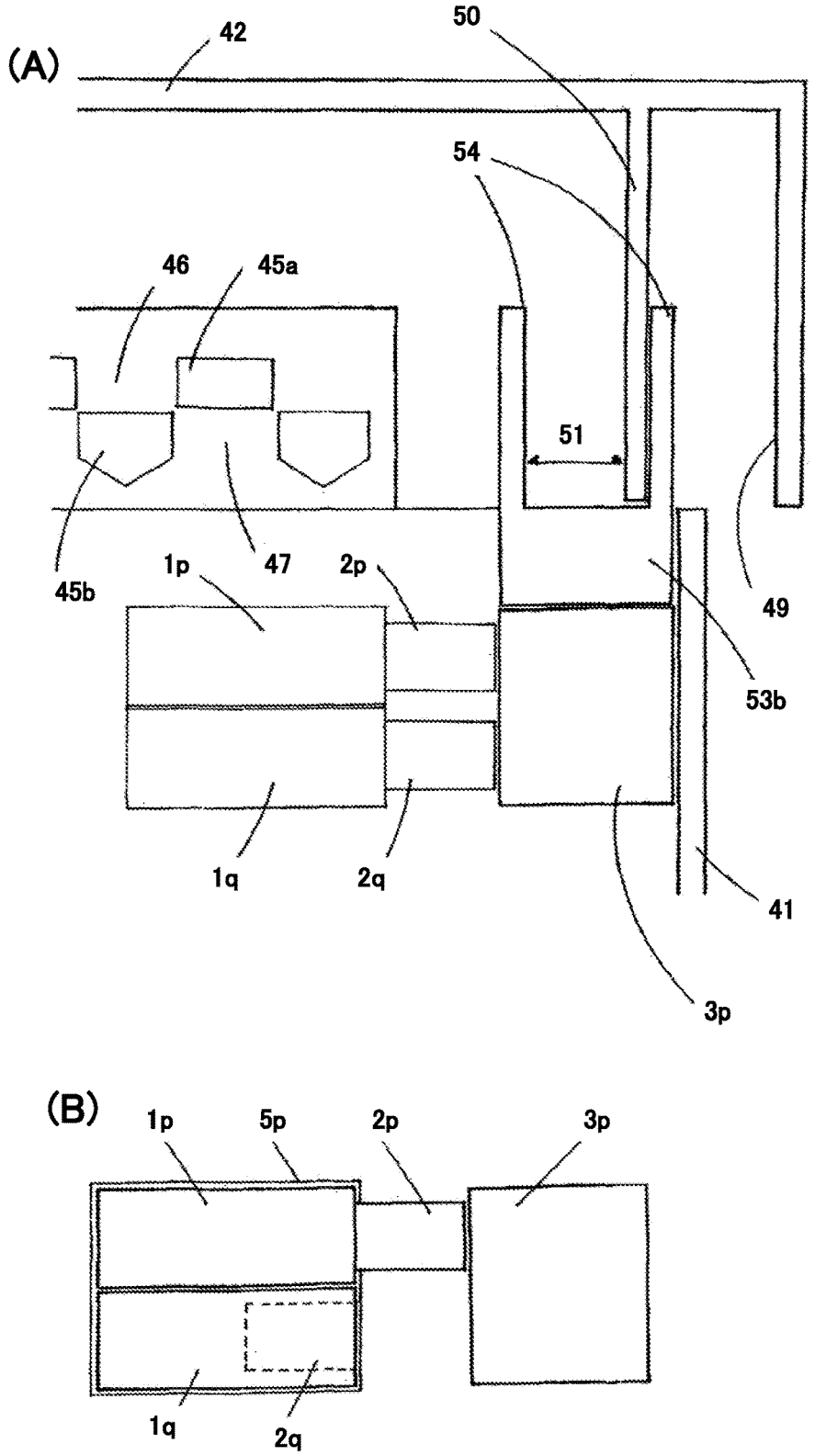
FIG. 12(A) is a cross-sectional view of a plurality of locks unlocked, with a lid moved laterally.
FIG. 12(B) is a cross-sectional view illustrative of the relationship between a plurality of locks and the protective member.
Figure 13:
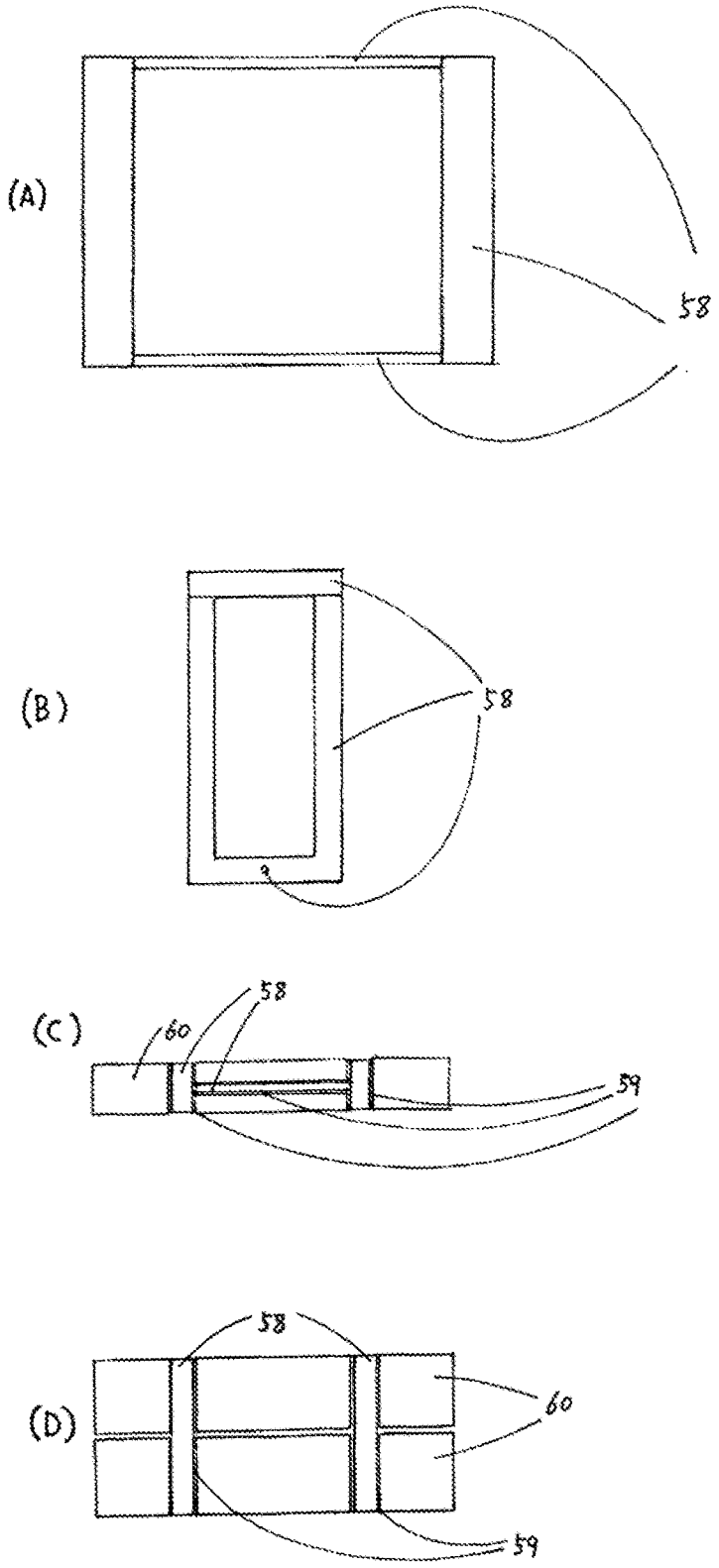
FIG. 13(A) and FIG. 13(B) are schematic views of a lock receiving case, respectively.
FIG. 13(C) is a bottom view of an engaging recess of a lock.
FIG. 13(D) is a schematic view of a plurality of locks and the lock receiving case in an engaged state.

From the perspective of a method for use with a parallel slidable safe proper, referring to FIG. 11(A)~FIG. 11(C) which show the body 41 and the lid 42, a panel 48 extending upward is disposed at the fringes 43 in front of and behind an identity opening of the body 41 of FIG. 11(A), and latches 45*a* which are bracket-shaped and raised-portion-shaped are disposed at a local point and spaced apart equidistantly. Referring to FIG. 11(C), the latches 45*a*, which are raised-portion-shaped, face the outside of the body 41, whereas the panels 48 are disposed horizontally and equidistantly. Referring to FIG. 11(B), latches 45*b*, each of which is raised-portion-shaped and extends toward the inside of the lid 42 in a bracket-shaped manner, are disposed horizontally and equidistantly at a local point of an inward wall 44 disposed in front of and behind the lid 42. Referring to FIG. 12(A), the latches 45*b* are each pushed downward to thereby be inserted into and engaged with a spacing portion 46 of a corresponding one of the latches 45*a*, such that the latches 45*b* slide to right-down positions 47 of the latches 45*a* to thereby be opposite to each other, with their vertical movement gets clutched, thereby forming a stopped state.

From the perspective of a method of locking the safe proper, a lock 10 of a lock mounting portion 5*o* mounted on the body 41 of FIG. 10 is locked, and a latch 2*o* is protruded leftward to thereby drive a protective member 3*o* to region 4*q*, so as to clutch and stop the vertical movement of a latch 53*a*. The latch 53*a* has two front end plates 54 which extend upward. The protective member 3*o* gets clutched, because the two front end plates 54 in a clutched state face the lateral inner side 49 of the lid 42 and an inner wall 50 disposed inside the lid 42, respectively. A latch 2*p* of a lock 1*p* and a latch 2*q* of a lock 1*q*, which are opposite to each other, clutch a common protective member 3*p* together. The common protective member 3*p* clutches the two front end plates 54 of a latch 53*b* while the two front end plates 54 are disposed opposite to the lateral inner side 49 of the lid 42 and the inner wall 50, and thus the lid 42 is prevented from moving leftward and rightward, thereby forming a stopped state. The inner wall 50 extends downward from the upper portion of the lid 42 to the inside of the lid 42. One front end plate 54 and the inner wall 50 are opposite to each other and clutched to preclude leftward and rightward movement. The inner wall serves a reinforcing purpose. Like the lid 42 in which inner walls are disposed, a latch has therein front end plates opposite to the inner walls and corresponding in quantity thereto.

From the perspective of a method of unlocking the safe proper, referring to FIG. 10, the method entails unlocking the lock 1*o* mounted on a lock mounting portion, receiving the latch 2*o* in the lock 1*o*, and driving the protective member 3*o* to region 4*o* to not only allow the latch 53*a* to move downward freely but also allow the front end plates 54 to move downward to the same height as the fringes 43, such that the latch 45*b* shown in FIG. 12(A) and capable of moving leftward and rightward slides rightward to the spacing portion 46 of the latch 45*a*. The latches 45*a* and latches 45*b* which are initially opposite to each other have now become no longer so; hence, the lid 42 and the body 41 are not only unlocked but also docked and separated.

The length of the floating width by which the lid 42 of FIG. 12(A) slides equals the difference obtained by subtracting a thickness width 52 of the inner wall 50 from a floating width 51. The inner wall is disposed between the floating width of the spacing portion 46 of the panel 48 and the two front end plates 54.

A latch retaining element which comprises the aforesaid protective members includes a lock mounting portion mounted at one point and undergoes a latch operation with a plurality of locks provided in odd numbers or downsized and equidistantly spaced apart, so as to lock the same latch retaining element. When performing a locking operation with a plurality of locks, even if any one of the locks is released, it will still be feasible for any other lock to maintain a locked state. Referring to FIG. 12(B), a latch 2*q* of a lock 1*q* mounted on a lock mounting portion 5*p* is received in the lock 1*q*, whereas the latch 2*p* of the lock 1*p* clutches the common protective member 3*p*. Hence, it is only when all the locks of the protective members locking are simultaneously unlocked that the protective members enter an unlocked state.

Furthermore, in embodiment 3, regarding the movement operation of the latches 53*a*, 53*b*, a knob (not shown) is disposed at each of the latches 53*a*, 53*b* such that the knob protrudes from a through-hole disposed on the body 41, thereby allowing the knob to be moved to thereby effectuate the movement operation. Alternatively, the knob and the through-hole can be dispensed with, as the latches 53*a*, 53*b* each function as a magnetic body, and in consequence a user of the safe proper can move the latches 53*a*, 53*b* with a magnet from outside.

From the perspective of common features of embodiments 1~3, in an example about a means of mounting a lock on a lock mounting portion of the body of the safe proper easily, there is a method for changing a lock of a lock receiving case of a dedicated accessory member, wherein odd-numbered locks or the lock receiving case for mounting a plurality of locks in a single instance can be easily mounted on and dismounted from the lock mounting portion. At this point in time, a fastener, a clutch member, or a lid is provided to fasten a lock mounted at an opening end of the lock receiving case. Referring to FIG. 13(A)~FIG. 13(D), the lock receiving case comprises a raised member 58, wherein the lock 60 has a recess 59 engaged with the lock receiving case and corresponding in position to the raised member 58. The method employs a means of opening one end of the raised member 58 of a portion of the lock receiving case, and the raised member 58 of the lock receiving case gets engaged with the recesses 59 of the lock 60. Given the means, the lock 60 or locks 60 shown in FIG. 13(D) and equidistantly spaced apart and downsized are mounted on the lock receiving case, without changing the dimensions and shape (or volume or capacity) of the lock 60 of FIG. 13(C). In the situation where only odd-numbered, equidistantly spaced apart and downsized locks 60 which are mounted cavitation members which have the same shape as the lock can occupy the space provided by the lock receiving case.

Figure 14:
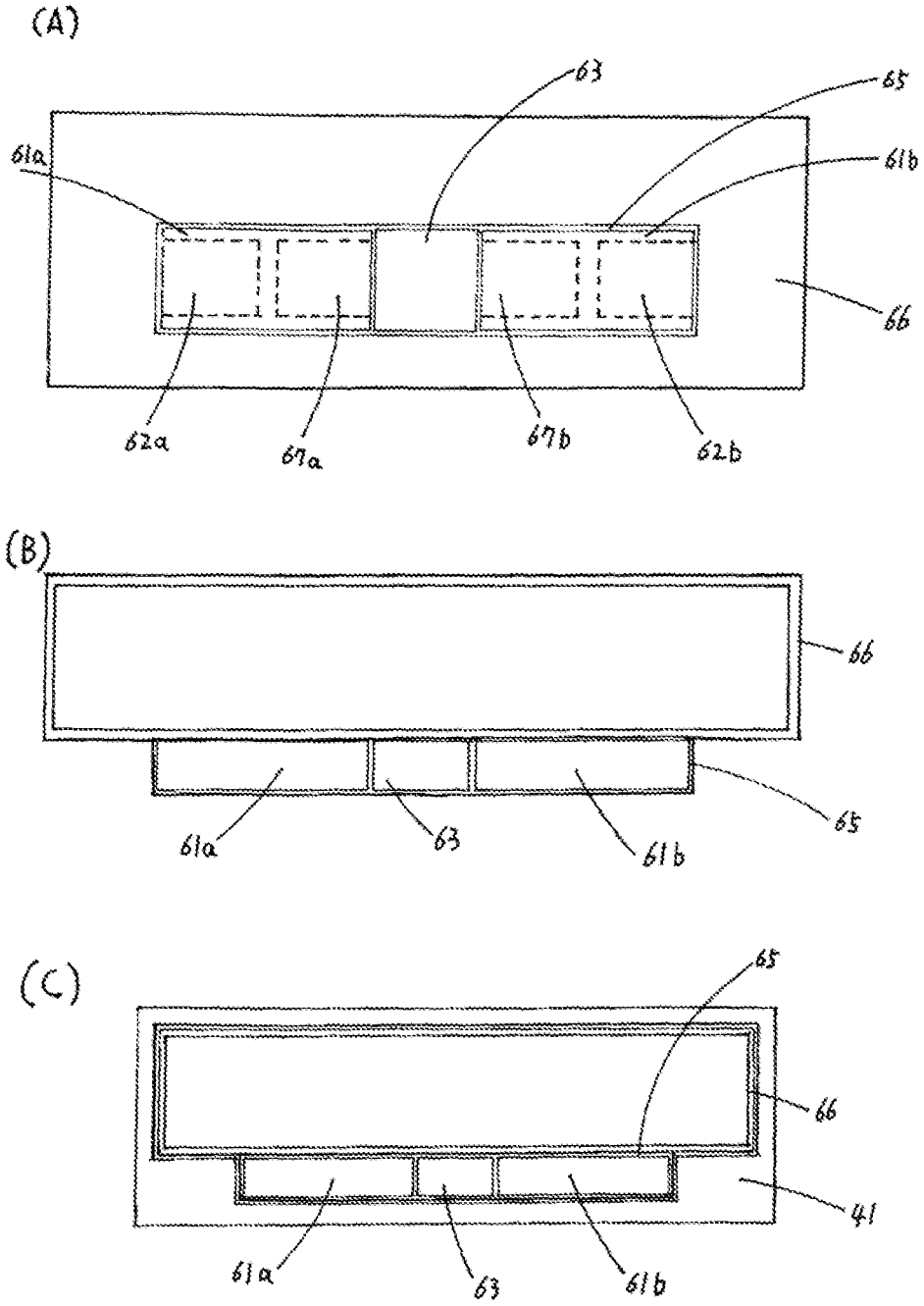

An embodiment of the present invention provides a means whereby a plurality of locks mounted on the lock mounting portion can be easily mounted on and dismounted from the safe proper, and a method for use with the lock clutching member engaged with the lock mounting portion as shown in FIG. 14(A)~FIG. 14(C). Referring to FIG. 14(B), the central portion of a lock mounting portion 65 of a plurality of locks 61*a*, 61*b* is engaged with a lock clutching member 63 to clutch the lock 61*a* and lock 61*b*. Given a latch 62*a* or false lock 67*a* of the lock 61*a* mounted on the lock mounting portion 65 of FIG. 14(A) or in the state of the protrusion of a latch 62*b* or false lock 67*a* of the lock 61*b*, the lock clutching member 63 clutched and fixed to the central portion of the lock mounting portion 65 is removed therefrom, and the lock 61*a* or 61*b* slides within the provided space, so as to take the lock 61*a* or the lock 61*b* out of the lock mounting portion 65.

A means whereby a lock mounting/dismounting engaging member 66 of the lock mounting portion 65 which a plurality of locks 61*a*, 61*b* of FIG. 14(C) is mounted on is driven to the inside of the body 41 for an engagement purpose is provided, such that a plurality of locks can be easily mounted on and dismounted from the body 41. Alternatively, the lock mounting/dismounting engaging member 66 engages with the lid 42. Moreover, the lock mounting/dismounting engaging member 66 has a cylindrical shape, a lid-like shape, or a panel-like shape, but the present invention is not limited to the aforesaid shapes. In another embodiment, the lock mounting/dismounting engaging member is standalone, does not have any lock mounting portion, and functions as a lid to cause a lock mounting portion (provided in the form of a lock mounting portion device) to engage with the space of the body and thus replace a fastener, such that the lock mounting/dismounting engaging member abuts against and engages with the lock mounting portion, thereby suppressing the lock mounting portion. In this situation, the lock mounting/dismounting engaging member and the lock mounting portion are mounted and dismounted relative to the body or the lid, respectively.

Regarding the structure of the safe proper of embodiments 1~3, safety modes, such as the forms of the body and the lid rotate (helical), or allowing the body and the lid to have the same dimension and thus be pivotally mounted oppositely, and providing double structures, such as a small room in the body and locking/unlocking-oriented operating portions provided at various parts, are not only applicable to embodiments 1~3 but also applicable to various structures and methods. Mounting the lock on the lock mounting portion of the safe proper requires members for fastening the lid or clutching the fastener or mounting portion of the lock to thereby allow the aforesaid elements to be firmly fastened to the lock mounting portion.

Figure 15:
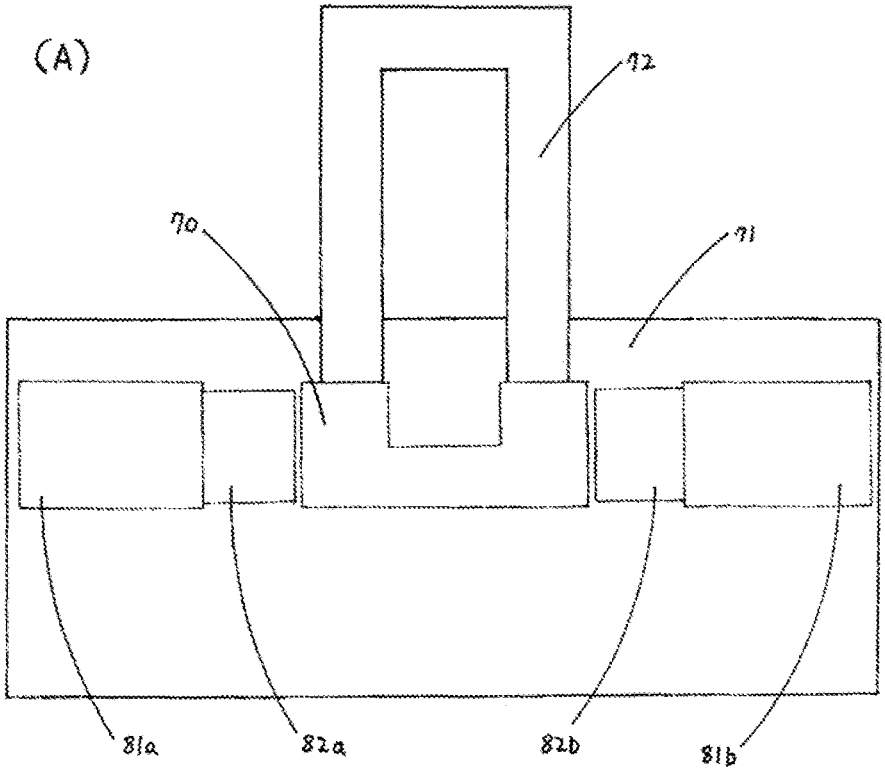
FIG. 15(A) is a front cross-sectional view of a lock device.
FIG. 15(B) is a top view of an aperture on the body.
Figure 15:
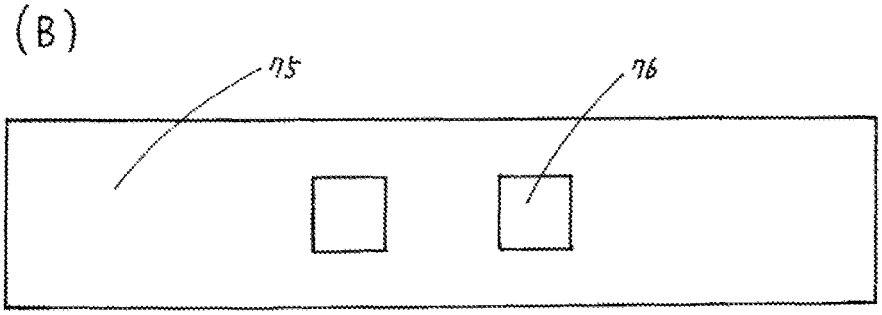

In a variant embodiment of the present invention, a plurality of locks is mounted on a lock device. FIG. 15(A) is a front longitudinal cross-sectional view of a lid 72 and a body 71 of a lock device having a plurality of locks and a common latch. Referring to FIG. 15(B), an aperture 76 is disposed on the body upper surface 75 of the body 71.

Figure 16:
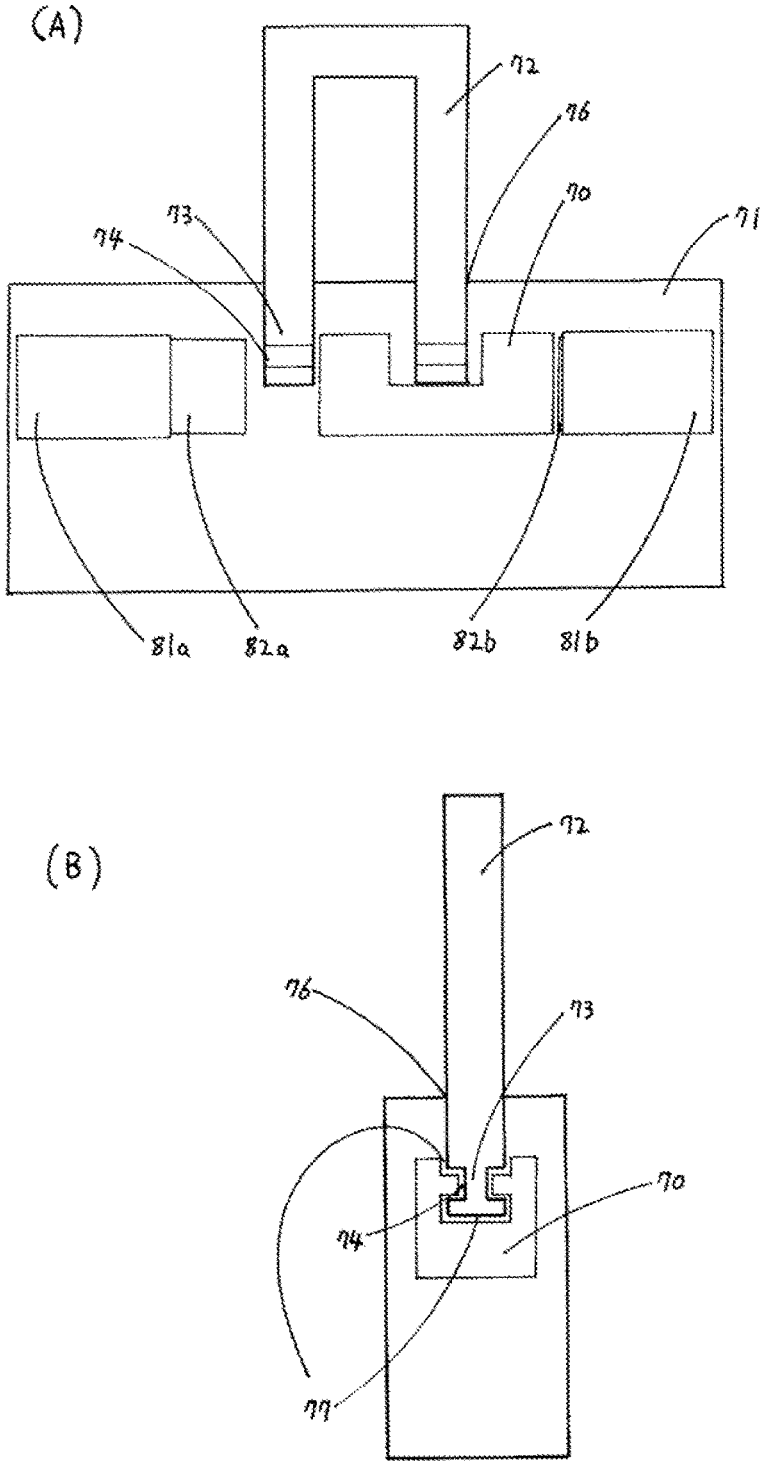
FIG. 16(A) is a front cross-sectional view of an unlocked state of a common fastening member.
FIG. 16(B) is a cross-sectional view of an engaging portion of the lid and the body common fastening member.

From the perspective of the operation of the lock device, FIG. 16(A) shows that the lid 72 is n-shaped as it has two legs extending downward. At a local point of a lower edge portion 73 of each of the two legs, a notch engaging portion 74 of FIG. 16(B) is disposed at the front and rear of the lock device equally. The body 71 has a notch engaging portion 77 at a plurality of local points of a common fastening member 70. At the lower edge portion 73 of each pin of the lid 72 which engages with the aperture 76 of the body upper surface 75, the common fastening member 70 slides leftward. In the situation where the body 71 aligns with the axis of the lid 72, the notch engaging portions 77 of the common fastening member 70 clamp a plurality of notch engaging portions 74 of the lid 72 of FIG. 16(B) from outside in an enclosing and opposing manner. If locks 81*a*, 81*b* which flank the common fastening member 70 of FIG. 15(A) are stopped, the common fastening member 70 will be prevented from moving leftward and rightward, thereby becoming a structure in a stopped state.

From the perspective of a method of locking a lock device, the lock 81*a* of the body is locked to enable a latch 82*a* to protrude, and latches 82*b*, 82*a* currently in a locked state allow the common fastening member 70 capable of moving leftward and rightward to stop at a central position, wherein the notch engaging portions 77, 74 of FIG. 16(B) clamp each other to thereby enter a locked state for clutching vertical movement.

Figure 17:
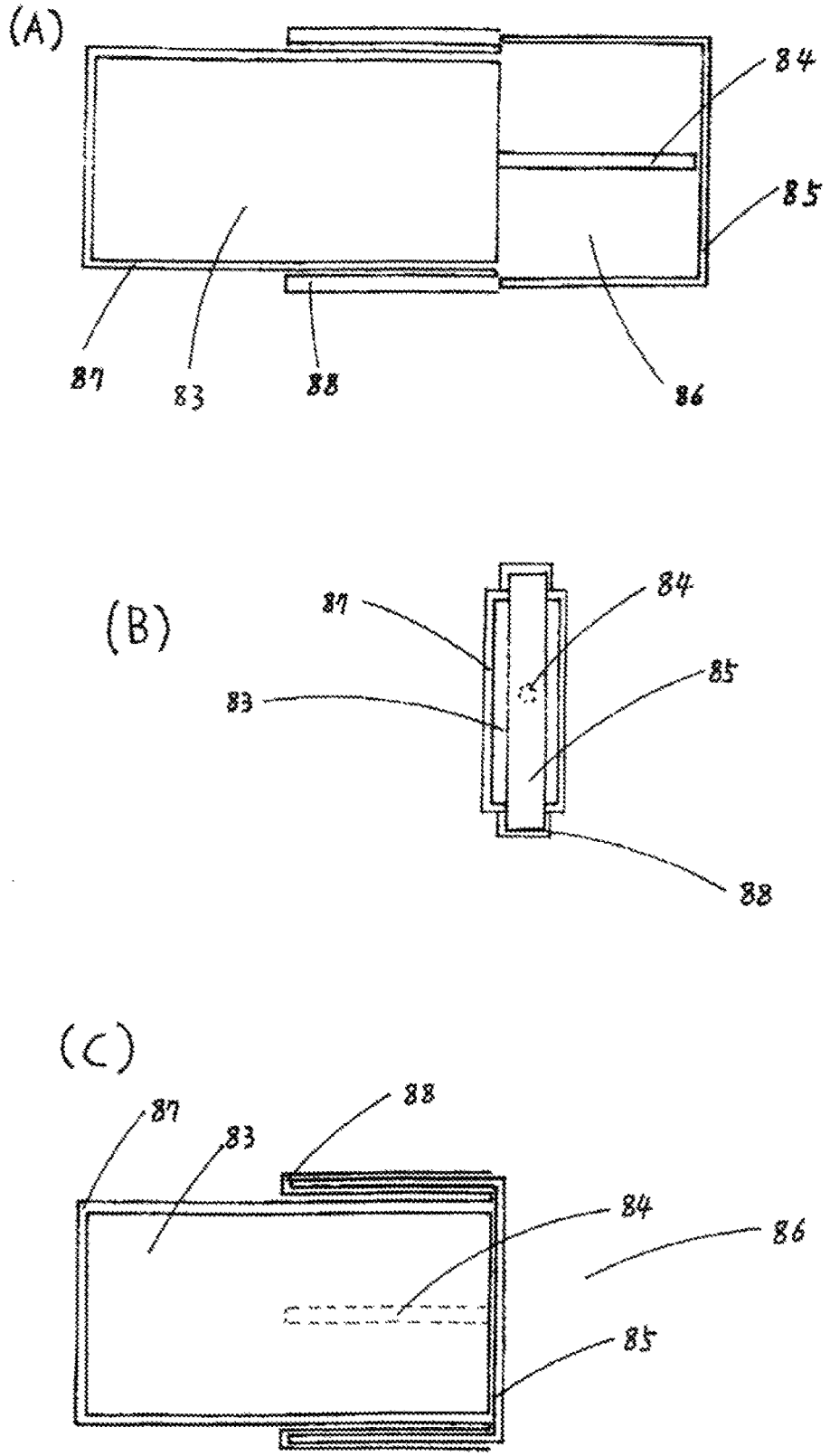
FIG. 17(A) is a front cross-sectional view of a locked state of a lock mounted on the lock mounting portion, a latch holder, and a door latch receiving recess disposed on the outer side of the lock mounting portion.
FIG. 17(B) is a lateral cross-sectional view of the lock and the latch holder.
FIG. 17(C) is a front cross-sectional view of an unlocked state of the latch holder and the lock.

From the perspective of a method of unlocking a lock device, the method entails unlocking the lock 81*a*, receiving the latch 82*b* in the lock 81*a*, and sliding the common fastening member 70 of FIG. 16(A) from the middle to the left such that the notch engaging portions 74, 77 which are initially opposite to each other have now become no longer so; hence, the body 71 and the lid 72 can be unlocked. The notch engaging portions 74, 77 are provided in the same number, and, for the sake of reinforcement, the number (not shown) of the notch engaging portions 74, 77 can be increased as needed. Furthermore, as mentioned before, the lock 81*a* is already unlocked, but it is also feasible for the lock 81*b* to be unlocked and feasible for the common fastening member 70 shown in FIG. 16(A) to slide from the middle to the right, so as to not only release the engagement of the face-to-face notch engaging portions 74, 77, but also unlock the body 71 and the lid 72. Regarding the other examples, FIG. 17(A) depicts a variant embodiment in which the locks 81*a*, 81*b* are mounted longitudinally. In this variant embodiment, an example about a means of performing a locking/unlocking operation on a lock is disclosed, wherein a common fastening member of an identity opening is not disposed between the protective members of a lock mechanism, and the lock device directly confines one end or two ends of a member and an object or member of an anti-theft target to the lid 72 by tying the one end or two ends with a chain and a metal wire, and engaging or stopping the object or member.

A variant embodiment of a latch retaining element of a lock mechanism with reference to embodiments 2, 3 is described below. The latch retaining element which comprises the protective members is characterized in that: latches of a plurality of locks, which are odd-numbered or mounted on the lock mounting portion of the lock mechanism, are engaged by being enclosed, hidden or concealed so as to be moved, adapted to evade any direct attack on the latches of the lock, and adapted to protect the latches of the lock.

For example, a latch retaining element of FIG. 17(A) ~FIG. 17(C) is engaged with a latch receiving recess 88 disposed on the outer side of a lock mounting portion 87 and shown in FIG. 17(A) and FIG. 17(B) to extend along the guide groove and thus get partially received (not shown). The latch retaining element is provided in the form of a latch retaining element 85 which is fine, panel-shaped and ⊐-shaped and can be operated with a fine pin-shaped latch 84 of the lock 83. A part of a region 86 is dispensed with the protective members of FIG. 17(C), and it is feasible to make good use of the area assigned to such a part of the region 86 to thereby enhance the functions and features of the latch retaining element as well as render a lock and the latches and the protective members of the lock lightweight.

The structures of the aforesaid locks and false locks are described.

Figure 18:
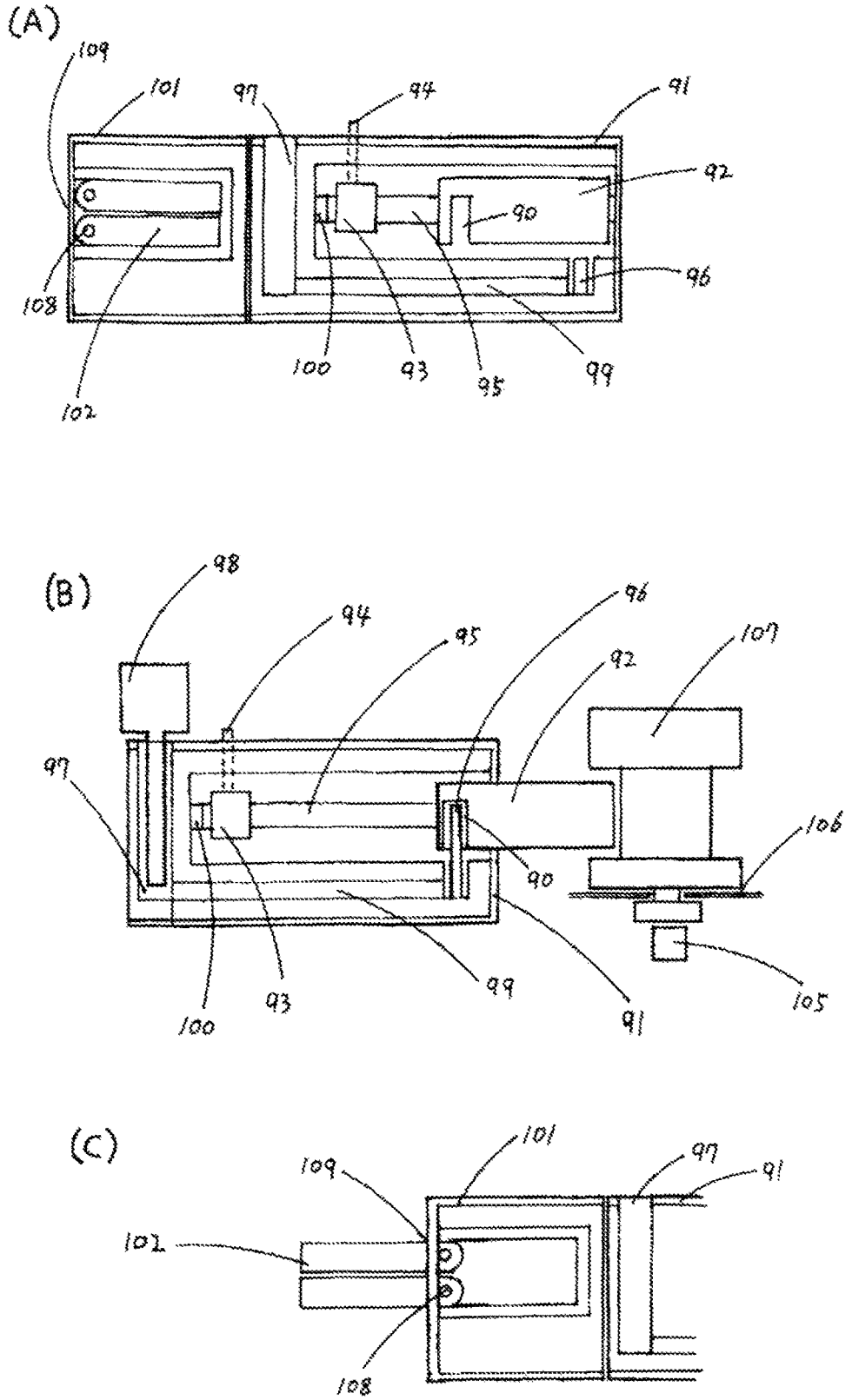
FIG. 18(A) is a cross-sectional view of a lock and a false lock.
FIG. 18(B) is a cross-sectional view of a lock in a locked state.
FIG. 18(C) is a schematic view of the false lock in an upright state.

Referring to FIG. 18(A), a guide groove 95, which is linear, is penetratingly disposed inside a lock 91 and adapted to operate a handle 94 capable of moving freely. Hence, a pushing member 93 which engages with the handle 94 is guided along the guide groove 95 to thereby push and lock a latch 92. After the pushing member 93 of FIG. 18(B) has driven the latch 92 to the locking destination, a latch stopping member 96 protrudes because of the elastomer and the like to thereby engage with a recess 90 of the latch 92, such that the latch 92 gets clutched. Alternatively, after a key 98 has been inserted into a locking/unlocking operating portion 97 of a lock 91 and then rotated, an engaging member 99 and the latch stopping member 96 move in response to the aforesaid operation, thereby pushing out or receiving the latch stopping member 96. To lock the latch 92, an elastomer 100 which engages with the pushing member 93 and the latch 92 restores the pushing member 93 in a free state to its original position. From the perspective of advantages, once the latch 92 is locked, the pushing member 93 cannot adopt, relative to the latch 92, a corresponding movement means to stop a forcible unlocking means for use with the latches.

In another embodiment, even though the locking/unlocking operating portion 97 or the handle 94 of the pushing member 93 is in a non-contact state in which a superficial member of a lock is formed and clamped, a magnetic body is disposed in each of the pushing member 93, an operating member operable from outside, and a key such that the magnetic bodies separate from each other as soon as the key is moved at a specific speed and under a specific force by the respective engaging means for use with the magnetic bodies, and in consequence it is impossible to perform any forcible locking/unlocking operation of the pushing member 93.

Moreover, a lock free of any aperture but is glossy and delicate can be manufactured by an operating means of operating a locking/unlocking operating portion disposed at the lock with electromagnetic waves or light rays in a non-contact state (with reference to the diagrams illustrative of the aforesaid embodiments). The present invention is also applicable to a locking/unlocking operating means for use in a non-contact state regarding the safe proper which is waterproof and free of any aperture.

Take a false lock of FIG. 18(A) as an example, a false lock 102 is disposed inside a member of the lock 91, and the lock forms a cap shape which is removable. To use the false lock 102, the user has to remove a cap 101. The false lock 102 which comprises two members is rotated outward bilaterally by 180 degrees in the same manner as a clasp knife is and then kept in an upright state. Afterward, referring to FIG. 18(C), the cap 101 gets engaged with the body of the lock 91 while penetrating the aperture on the top surface of the cap 101, so as to be operating in the event of forcible stopping.

Figure 19:
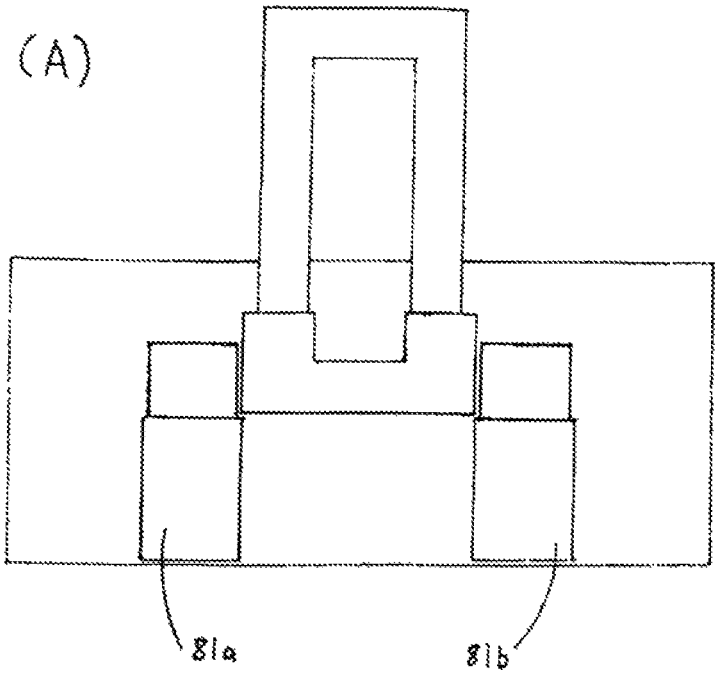
FIG. 19(A) is a front cross-sectional view of locks mounted longitudinally on the body of FIG. 15.
FIG. 19(B) is a cross-sectional view of a plurality of locks in a locked state.
Figure 19:
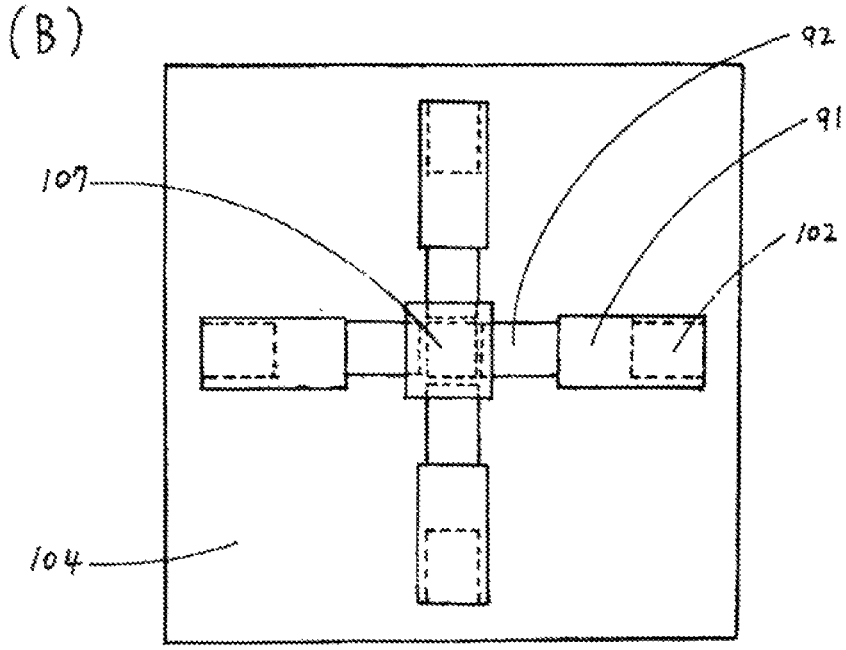

The diverse use of a lock of the present invention is described below. Referring to FIG. 19(A), there is shown a variant embodiment where the locks 81*a*, 81*b* of FIG. 15(A) are mounted longitudinally.

Referring to FIG. 19(B), in another embodiment, a common fastening member disposed right above an on/off switch in the central inside of the safe proper to surround and engage with the latch of a plurality of locks. The locking/unlocking operating portion 97 of any one of the locks 91 of FIG. 18(A) undergoes an unlocking operation with the key 98, such that the stopped latch 92 of a common fastening member 107 is received in the lock 91, the common fastening member 107 is moved in the unlocking direction along a through-hole on one side of a raised member 106 guided by a through hole which penetrates cruciformly a body 104 to prevent a common latch from escaping, so as to open the central portion of the through-hole of the body 104, operate an on/off switch 105 and open/shut the safe proper. The body 104 also has a means of forcibly stopping the false lock 102 of FIG. 18(C). The present invention is further applied to the safe proper with more locks or polyhedrons (octahedrons, icositetrahedrons, etc.)

In the above description, all the locks or false locks can be inserted into the lock mounting portion in a freely mountable and demountable manner, but the present invention also includes locks and false locks fixed to the body or lid.

Figure 20:
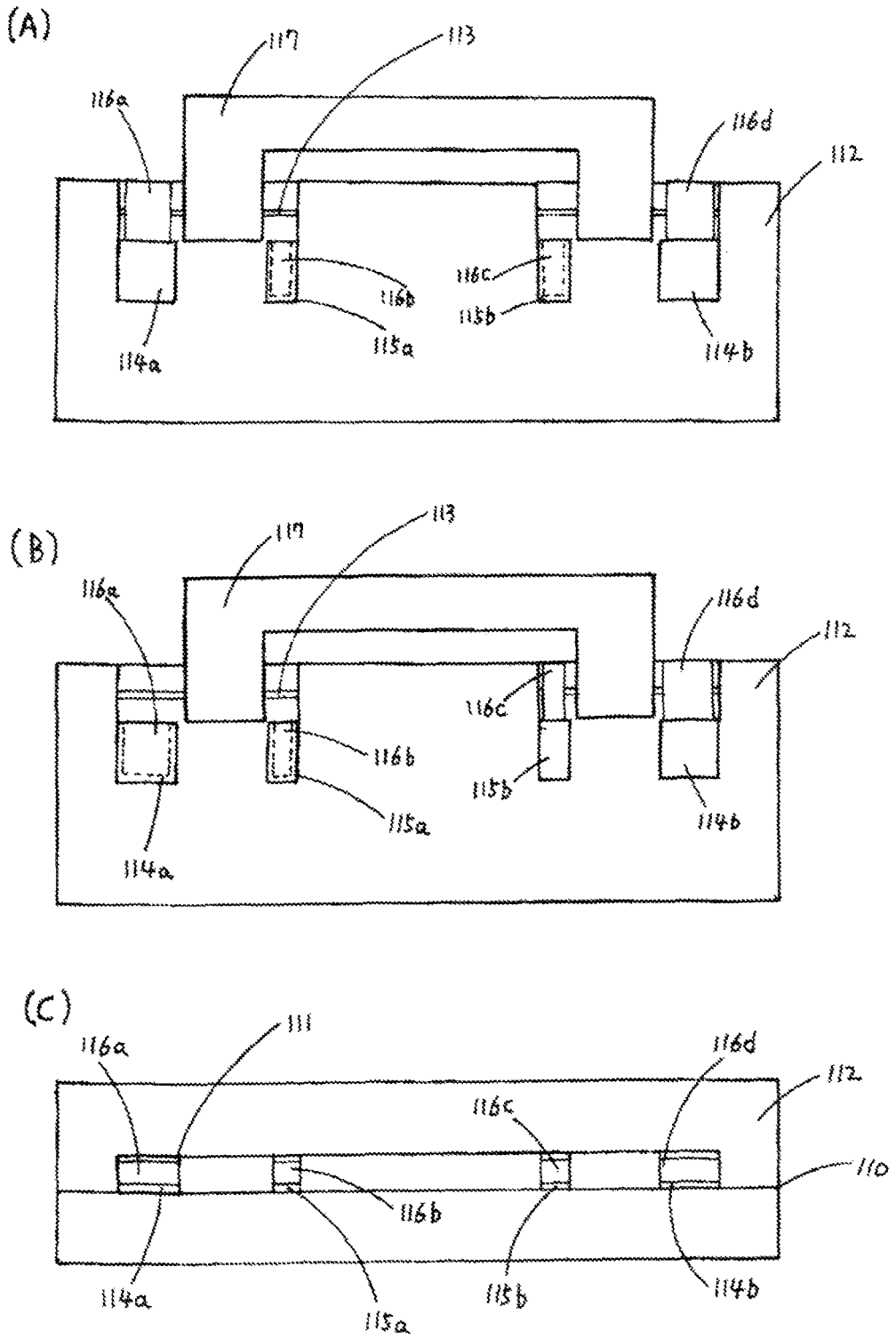
FIG. 20(A) is a schematic view of locking/unlocking operating members which are locked.
FIG. 20(B) is a cross-sectional view of the common fastening member which is forcibly stopped.
FIG. 20(C) is a schematic view of an aperture of an identity opening.

Take a lock fixed in place as an example, an identity opening 110 of FIG. 20(C) comprises: an aperture 111 disposed on a body 112; and a guide groove 113 disposed inside the body 112 of FIG. 20(A). A plurality of locking/unlocking operating members 114*a*, 114*b* fixed in place and stopping members 115*a*, 115*b* are freely movable along the aperture 111 and the guide groove 113 to operate in conjunction with a common fastening member 117 capable of being gripped and attributed to the body 112. From the perspective of a locking method, the common fastening member 117 is stopped in two outward directions by latches 116*a*, 116*d* of a plurality of locking/unlocking operating members 114*a*, 114*b* fixed in place inside the body 112. Since any one of the locking/unlocking operating members 114*a* or 114*b* is unlocked, the common fastening member 117 can move freely along the guide groove 113 to thereby release the engagement of an engaging groove of the body, thus opening the identity opening 110 of the body 112. In the situation where the locking/unlocking operating member 114*a* cannot be locked, the latch 116*c* of the stopping member 115*b* of FIG. 20(B) causes the common fastening member 117 to be forcibly stopped, whereas the latches 116*c*, 116*d* clamp the common fastening member 117 from the right to effectuate locking. From the perspective of an unlocking method, when the latch 116*d* of the locking/unlocking operating member 114*b* is unlocked, the common fastening member 117 moves rightward and thus opens the identity opening 110. When locked, the common fastening member 117 engages with the engaging groove of the body and thus cannot be removed.

From the perspective of advantages, the safe is prevented from being broken apart, because locking/unlocking operating members and stopping members are firmly fixed in place inside an identity opening and thus restricted by the frame and the shape of the body.

Even though locking/unlocking operating members and stopping members are firmly fixed in place inside an identity opening and thus a plurality of locks and false locks freely mountable and demountable have the same advantage, it is feasible for a forcibly stopping means to stop a common fastening member and for the safe proper to operate continuously. Furthermore, the aforesaid locking/unlocking operating members and stopping members are firmly fixed to an object, such as a frame, which forms the identity opening, thereby enhancing durability.

In the aforesaid embodiments and variant embodiments, members each denoted by a reference sign with the suffix "a" when a description of the structure and function is not required are also disposed at a back surface portion (not shown) of the safe proper and bilaterally symmetric portions as needed. The aforesaid embodiments and variant embodiments are illustrative of the present invention.

Moreover, in the aforesaid embodiments and variant embodiments, regarding locking, an operating portion is exposed from a hole disposed on the body or lid. The fastening of the handle is released as soon as the key is inserted into a keyhole and rotated, and thus the handle becomes freely movable, thereby allowing the latch to protrude or retract. Furthermore, it is also feasible for the keyhole and key to be replaced with a combination lock such that the fastening of the handle is released as soon as numerals inscribed on rotating discs match a specific number. Furthermore, both the keyhole and the combination lock can be dispensed with, as the key, which operates in the same way as a key for a door of a vehicle, approaches a lock to thereby unlock or lock the lock in a non-contact manner. Furthermore, the aforesaid handle can be dispensed with, as the key is inserted into a keyhole and rotated such that the latch of the lock protrudes or retracts as soon as the numerals of the combination lock match or the user presses a button of the non-contact key. In this situation, the operating portion of the handle for use in locking is not exposed from the body and lid.

Furthermore, the lock, lock member, lock mechanism having the lock member in the aforesaid embodiments of the present invention are described above with reference to unlocked and locked locks for use with the body and lid, but the present invention is not limited thereto; instead, the lock, lock member, lock mechanism having the lock member in the aforesaid embodiments of the present invention are applicable to unlimited purposes, including buildings, receiving members, transport objects each having a receiving portion, and device or member capable of being locked in terms of the opening and shutting of the body and the door.

According to the present invention, the safes proper are rendered transparent such that not only can the safes proper be examined without being opened even if they have the same shape, but the safes proper can also be manufactured by mass production to cut their manufacturing costs. Furthermore, the impact of any received objects can be minimized by stacking up safes proper of different dimensions and putting vibration-reducing substances between the stacked safes proper. Moreover, the safe proper is portable when equipped with a handle or a shoulder strap. The safe proper can come with a hermetic seal confirmation function for confirming any trace of a third party's unlocking behavior. The safe proper can come with a solution to the prevention of unauthorized use, or the key is attached to objects, such as clothes and ornaments, such that users can often wear the key to prevent crimes.

Furthermore, the safe proper exhibits exchangeability and thus its lock can be changed easily. The safe proper features printing-based design and processing, round-angle design, multiple angle design, multifaceted design, animal simulation, plant simulation, and a combination of multiple various shapes, so that the safe proper is not only stylish but also flexible enough to be carried with a bag and thus portable. Also, the inside of the safe proper can be instantaneously concealed by a liquid-crystal effect. Furthermore, a change can be easily performed on the spot by buying and changing related parts and components at the destination of a trip or carrying a "transportation security administration lock" (TSA lock), a "mixed lock" or a "biometric feature recognition lock." Inspectors can conduct a safety check on the safe proper of the present invention with the naked eye or x-ray, without opening the safe proper, thereby speeding up the safety check. Furthermore, password cracking is prevented by a solution to the prevention of unauthorized use, penetrative imaging solutions, such as optical electronic rays, including infrared or x-ray, or the inside of the safe proper can be instantaneously concealed by a liquid-crystal effect. The present invention provides a lock and a safe proper, characterized in that: the aforesaid means effectuate persistent use of the safe proper. Furthermore, by changing part of the parts and components, it is practical to reduce wastes and discarded substances. Users can choose the types of locks and the shapes of the safe proper with reference according to its purposes and objectives. Furthermore, the locks and the safe proper of the present invention may function as helmets and shields to protect the users during a terror attack or disaster.

What is claimed is:

1. A lock mechanism for an opening at a junction of a body and a door capable of being opened and shut freely, the lock mechanism comprising:

a fastening member;

a plurality of lock mounting portions disposed at the body, the door or both; and a plurality of locks, wherein each of the plurality of locks has a latch and a false lock, each of the plurality of lock mounting portions is configured to allow removable mounting of a lock clutching member which constrains movement of the fastening member and to mount a lock of the plurality of locks when the lock clutching member is removed, using a space created by removal of the lock clutching member to receive the latch or the false lock of the lock such that the latch or the false lock constrains movement of the fastening member and such that the lock can be mounted on or dismounted from the lock mounting portion in a locked state wherein the latch protrudes or the false lock is raised, and the lock mechanism being configured such that:

when any one of the locks is in a locked state and cannot be unlocked, the fastening member can be controllably kept in an unlocked state or a locked state with the one of the locks being mounted to the lock mounting portion in the locked state such that the latch of the lock protrudes and is received in the space so as to constrain the fastening member and a latch of an other lock mounted to another lock mounting portion moving in response to operation of a locking/unlocking-oriented operating portion of the other lock to thereby controllably constrain the fastening member and thereby allow opening and shutting of the opening, and when the one of the locks is in an unlocked state and cannot be locked, the fastening member can be controllably kept in a locked state or an unlocked state with the one of the locks mounted to the lock mounting portion with the false lock being raised and received in the space so as to constrain the fastening member and the latch of the other lock mounted to the other lock mounting portion moving in response to operation of the locking/unlocking-oriented operating portion of the other lock, to thereby controllably constrain the fastening member and thereby controllably allow opening and shutting of the opening.

2. The lock mechanism of claim 1, wherein the lock is mounted on the lock mounting portion while a main surface of an operating portion disposed in the lock is rotated and the operating portion is concealed from outside the opening, so as to prevent operation of the operating portion from outside the opening.

3. The lock mechanism of claim 1, wherein a main surface having the operating portion or an other surface being opposite to the main surface and without the operating portion is mounted on the lock mounting portion, while facing the body or a display surface of the door, and the lock with the latch in a locked state that protrudes or with a false lock in an upright state is mounted and dismounted in a mounting/dismounting space.

4. The lock mechanism of claim 3, wherein the lock includes a plurality of downsized and spaced apart locks mounted on the lock mounting portion, the downsized and equidistantly spaced apart locks are stacked and mounted on the lock mounting portion and perform a locking/unlocking operation on the locks, and a lock receiving case which the locks are stacked and mounted on is mounted and dismounted.

5. The lock mechanism of claim 1, further comprising a member having a shape of an entity independent of the lock and functioning as a false latch, wherein the member is mounted on the lock mounting portion and the fastening member is constrained by the member.

6. A lock mechanism of claim 1, further comprising protective members and a latch mechanism of latch-like members arranged in series, wherein a latch having a latch plate disposed in the lock mechanism is aligned with a body and an inner wall of a door capable of being opened and shut freely, movement of the latch and the body by a variation in arrangement of the latch is stopped while the latch plate and the inner wall are opposing each other, facing each other, or engaging with each other, and the protective member is arranged between the latch-like member disposed at the lock mechanism and the latch of the lock, thereby reducing, evading or blocking a destructive force directly sustained from the outside relative to the latch of the lock.

7. The lock mechanism of claim 1, further comprising a protective member arranged between a latch-like member disposed at the lock mechanism and the latch of the lock to thereby enclose or hide the latch of the lock.

8. The lock mechanism of claim 7, having an inclined plane forming a wedge between the protective member and a latch-like member, such that a pressing force of the latch-like member being abutted against the inclined plane produces a wedging effect from and pushes the protective member inward in a locking direction, thereby augmenting a stopping force.

9. The lock mechanism of claim 8, further comprising a horizontal stabilizing member, disposed at a local point of an inclined plane of the latch-like member and adapted to keep the inclined plane horizontal, wherein, under a specific pressing force, the horizontal stabilizing member is abutted against and deformed to form an angle of the inclined plane and produce a wedging effect with the angle of the inclined plane of the latch-like member, thereby enhancing the locking as a result of a force exerted in a stopping direction in proportion to the pressing force.

10. The lock mechanism of claim 7, wherein downsized and equidistantly spaced apart locks are mounted on the lock mounting portion to allow the latches to clutch the protective member simultaneously because of the locking operation of the locks and keeping a common fastening member in a locked state, such that the protective member clutched by the latches enter an operating state to allow the fastening member to effectuate an unlocked state only when the latches are unlocked simultaneously because of the unlocking operation of the locks.

11. The lock mechanism of claim 1, further comprising a lock receiving case wherein laminated, downsized and equidistantly spaced apart locks are stacked to performed a locking/unlocking operation of the locks for simultaneous use, and the lock receiving case allows a lock engaging portion of the lock receiving case to engage with the lock engaging portions of the locks exhibiting exchangeability and the lock receiving case which the locks are mounted on the lock mounting portion without changing one of outer shape and outer capacity of the locks.

12. A combination of a body and a door capable of being opened and shut freely, comprising the lock mechanism of claim 1 and applicable to one of a building, a receiving member, a transport object having a receiving portion, and a device or member capable of being locked.

13. A safe comprising the combination of claim 12, the safe having a shape effectuated by a fiber reinforced plastic conclusive of a transparent or translucent synthetic resin or composite material, wherein an inside of the safe proper is concealed by a locking/unlocking-oriented operating portion of the lock with optical liquid crystals, electrical liquid crystals, or concealing members of the safe.

14. The lock mechanism of claim 1, further comprising a lock clutching member, that the lock can be mounted on and dismounted from the lock mounting portion even if the false lock and the latch of the lock are in one of a protruding state and a receiving state.

* * * * *